US006894699B2

(12) United States Patent
Someya et al.

(10) Patent No.: US 6,894,699 B2
(45) Date of Patent: May 17, 2005

(54) IMAGE DISPLAY DEVICE EMPLOYING SELECTIVE OR ASYMMETRICAL SMOOTHING

(75) Inventors: Jun Someya, Tokyo (JP); Yoshiaki Okuno, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 355 days.

(21) Appl. No.: 09/846,384

(22) Filed: May 2, 2001

(65) Prior Publication Data

US 2002/0008710 A1 Jan. 24, 2002

(30) Foreign Application Priority Data

Jul. 21, 2000 (JP) ..... 2000-220318
Jul. 28, 2000 (JP) ..... 2000-228690

(51) Int. Cl.[7] ..... G09G 5/00

(52) U.S. Cl. ..... 345/611; 345/606; 345/619; 345/629; 345/642; 382/254; 382/263; 382/264; 382/266; 382/269; 382/176

(58) Field of Search ..... 345/611, 606, 345/619, 629, 642; 382/254, 263–264, 266, 269, 176, 274, 275

(56) References Cited

U.S. PATENT DOCUMENTS 5,046,119 A * 9/1991 Hoffert et al. ..... 382/166
5,047,853 A * 9/1991 Hoffert et al. ..... 375/240.01
5,126,834 A * 6/1992 Enomoto et al. ..... 348/577
5,251,267 A * 10/1993 Kawamura ..... 382/176
5,444,798 A * 8/1995 Enomoto et al. ..... 382/199
5,987,185 A * 11/1999 Suzuki ..... 382/263
6,044,178 A * 3/2000 Lin ..... 382/260
6,563,511 B1 * 5/2003 Yeh et al. ..... 345/611
6,608,942 B1 * 8/2003 Le ..... 382/279

FOREIGN PATENT DOCUMENTS

JP A9181920 7/1997
JP A2000115542 4/2000

* cited by examiner

*Primary Examiner*—Matthew C. Bella
*Assistant Examiner*—Mike Rahmjoo
(74) *Attorney, Agent, or Firm*—Birch, Stewart, Kolasch & Birch, LLP

(57) ABSTRACT

An image display device includes a smoothing unit that filters the image data to be displayed. According to one aspect of the invention, only bright parts of the image that are adjacent to dark parts are smoothed, thereby improving the sharpness of dark dots and lines displayed on a bright background. According to another aspect, different primary colors are smoothed with different characteristics, enabling unwanted colored tinges to be removed from the edges of white areas. According to still another aspect, smoothing moves the luminance centroids of all primary colors in a direction in which the display screen is scanned, to reduce ringing effects without needless loss of edge sharpness.

18 Claims, 40 Drawing Sheets

IMAGE DISPLAY DEVICE EMPLOYING SELECTIVE OR ASYMMETRICAL SMOOTHING

BACKGROUND OF THE INVENTION

The present invention relates to an image display device and method, more particularly to a method of digitally processing an image signal to clarify lines, dots, and edges.

Images are displayed physically by a variety of devices, including the cathode-ray tube (CRT), liquid-crystal display (CRT), plasma display panel (PDP), light-emitting diode (LED) display, and electroluminescence (EL) panel. To display color images, these devices have separate light-emitting components for three primary colors, normally red, green, and blue.

In a CRT display, the separate colors are produced by a repeating pattern of red, green, and blue phosphor dots or stripes. FIG. 1 shows how a round white dot having a width of seven phosphor stripes, for example, is displayed. Electron beams illuminate red phosphors Rb, Rc, green phosphors Ga, Gb, Gc, and blue phosphors Ba, Bb in the spatial pattern shown. FIG. 2 maps the luminance distribution of this displayed dot in the horizontal direction. The distribution has separate luminance centroids R', B', G' for the three primary colors, but all three centroids are disposed near the center of the dot, near phosphor Gb in this example.

The other types of display devices mentioned above are flat panel matrix display devices comprising two-dimensional arrays of picture elements (pixels). In a color matrix display, each pixel includes separate cells of the three primary colors. For example, FIG. 3 shows an LCD pixel comprising a red cell R1, a green cell G1, and a blue cell B1. Personal computers often have matrix-type displays of this type.

Although there is a trend toward increasing resolution in matrix-type displays, it is difficult to fabricate a display screen with extremely small pixels, especially when each pixel comprises three separate cells. Since there is also a trend toward the display of increasing amounts of information on the display screen by the use of small fonts, it is not unusual for lines and dots with a width of just one pixel to be displayed.

FIG. 4 maps the luminance distribution in the horizontal direction of a white dot displayed as a single pixel in an LCD matrix. The red and blue luminance centroids R' and B' are considerably displaced from the center of the dot. Depending on the size of the pixel, the viewer may perceive a red tinge in the left part of the white dot and a blue tinge in the right part. The same tinged effect may also be visible in vertical white lines, and at the left and right edges of any white objects displayed against a darker background.

Another problem occurs when dark (for example, black) lines or letters are displayed on a bright (for example, white) background, to mimic the appearance of a printed page. It is generally true that bright objects tend to appear larger than dark objects. For example, a white pixel displayed against a black background appears larger than a black pixel displayed against a white background.

FIG. 5 shows the horizontal luminance distribution of a white pixel displayed on a black background. FIG. 6 shows the horizontal luminance distribution of a black pixel displayed on a white background. In both cases the display is a matrix-type display. ST0 to ST9 are pixels comprising respective sets of red, green, and blue cells. R0*a* to R9*a* are the luminance levels of the red cells, G0*a* to G9*a* are the luminance levels of the green cells, and B0*a* to B9*a* are the luminance levels of the blue cells.

The white pixel displayed as in FIG. 5 is perceived by the viewer as being larger than its actual size. Similarly, when fine bright lines are displayed on a dark background, they appear thicker than intended, and when bright text is displayed on a dark background, the letters may appear somewhat thickened. Still, the bright lines can be seen and the bright text can be read.

The black pixel displayed in FIG. 6, however, is perceived as being smaller than its actual size. When fine dark lines formed from dark dots are displayed on a bright background, the lines may become too faint to be seen easily. When dark text is displayed in a small font on a bright background, the letters may become difficult to read. These problems are aggravated in recent personal-computer display devices in which the resolution is increased and the pixel size is correspondingly reduced in order to increase the amount of information that can be displayed on the screen.

A known means of solving these problems is to use smoothing filters to reduce the sharpness of black-white boundaries, so that dark lines and letters do not appear too thin. Referring to FIG. 7, a conventional image display device in which this solution is adopted comprises analog-to-digital converters (ADCs) 1, 2, 3, smoothing units 5, 6, 7, and a display unit 8. The device receives analog input signals SR1, SG1, SB1 representing the red, green, and blue components of the image to be displayed. The analog-to-digital converters 1, 2, 3 convert these signals to corresponding digital signals SR2, SG2, SB2. These signals are filtered by the smoothing units 5, 6, 7 to obtain image data SR3, SG3, SB3 that are supplied to the display unit 8.

The smoothing units 5, 6, 7 operate with the characteristics FR1, FG1, FB1 illustrated in FIG. 8. These characteristics show how the image data SR2, SG2, SB2 for, in this case, three adjacent pixels STn, STn+1, STn+2 are used to calculate the filtered values for the central pixel STn+1, n being an arbitrary non-negative integer. The filtered luminance level SR3 of the red cell Rn+1 includes a large contribution from the original SR2 luminance level of this cell Rn+1 and smaller contributions from the original SR2 luminance levels of the adjacent red cells Rn and Rn+2, these two smaller contributions being mutually equal. Similarly, the filtered luminance level SG3 of green cell Gn+1 includes a large contribution from the SG2 level of cell Gn+1 and smaller, equal contributions from the SG2 levels of the adjacent green cells Gn and Gn+2. Likewise, the filtered luminance level SB3 of blue cell Bn+1 includes a large contribution from the SB2 level of cell Bn+1 and smaller, equal contributions from the SB2 levels of the adjacent blue cells Bn and Bn+2.

FIG. 9 shows the horizontal luminance distribution of a white pixel displayed on a black background after this filtering process. FIG. 10 shows the horizontal luminance distribution of a black pixel displayed on a white background after the same filtering process. These drawings may be compared with FIGS. 5 and 6. ST0 to ST9 are again pixels comprising respective sets of cells. R0*b* to R9*b* are the filtered luminance levels of the red cells, G0*b* to G9*b* are the filtered luminance levels of the green cells, and B0*b* to B9*b* are the filtered luminance levels of the blue cells.

In FIG. 9, the cell outputs in pixel ST2 are reduced by amounts R2*c*, G2*c*, B2*c* and the cell outputs in adjacent pixels ST1, ST3 are increased by amounts R1*c*, G1*c*, B1*c*, R3*c*, G3*c*, B3*c*, as compared with FIG. 5. In FIG. 10, the cell outputs in pixel ST7 are increased by double amounts R7c1+R7c2, G7c1+G7c2, B7c1+B7c2 and the cell outputs in adjacent pixels ST1, ST3 are reduced by amounts R6c, G6c, B6c, R8c, G8c, B8c, as compared with FIG. 6.

While this filtering process prevents the apparent decrease in size of dark dots and lines on bright backgrounds, it also leads to a certain loss of sharpness. In FIG. 9 the white dot in pixel ST2, which has an intrinsic tendency to appear larger than its actual size, is further enlarged by the redistribution of part of its luminance to adjacent pixels ST1 and ST3. In FIG. 10, the double increase in the luminance level of pixel ST7 implies a doubled loss of contrast with the background.

The conventional smoothing units 5, 6, 7 also fail to solve the problem of unwanted tinges of color at the right and left edges of white areas. FIG. 11 shows the locations of the red, green, and blue luminance centroids R', G', B' of a one-pixel white dot after the conventional filtering process described above. Since the three primary colors are filtered with identical characteristics, the luminance centroids are separated just as much as they were in FIG. 4.

A further problem occurs when the input analog signals are transmitted to the image display device through cables with imperfect impedance matching, leading to ringing phenomena. FIG. 12 illustrates the ringing effect in the display of a single white dot of arbitrary width, the horizontal axis indicating horizontal position on the display screen, the vertical axis indicating luminance. The display screen is generally scanned from left to right, so ringing occurs at the right edge of the white dot. FIG. 13 illustrates the effect of the filtering process described above. The ringing is reduced at the right edge E1, but the left edge E2 is needlessly smoothed, reducing the sharpness of the displayed image.

The problems described above are not restricted to flat panel matrix-type displays, but can also be seen on CRT displays.

SUMMARY OF THE INVENTION

An object of the present invention is to enhance the visibility of dark lines and dots displayed on a bright background.

Another object of the invention is to reduce colored tinges at the edges of white objects in a color image.

Another object is to suppress ringing effects without unnecessary loss of edge sharpness.

A first aspect of the invention provides an image display method including the following steps:

(a) detecting dark parts of the image;

(b) detecting bright parts of the image that are adjacent to the dark parts;

(c) smoothing the bright parts detected in step (b) by filtering the image data, leaving the dark parts unsmoothed; and (d) displaying the image data, including the smoothed bright parts and the unsmoothed dark parts.

This method enhances the visibility of dark lines and dots because these parts of the image are not smoothed.

A second aspect of the invention provides a color image display method including the following steps:

(a) smoothing the image by filtering the image data, using different filtering characteristics for different primary colors; and (b) displaying the image according to the filtered image data.

This method can reduce colored tinges by employing filtering characteristics that move the luminance centroids of the different primary colors closer together.

A third aspect of the invention provides a color image display method including the following steps:

(a) smoothing the image by filtering the image data, using filtering characteristics having centroids shifted in the same direction for all of the primary colors; and (b) displaying the image according to the filtered image data on a screen scanned in that direction.

This method reduces ringing at edges where ringing occurs, without unnecessary loss of sharpness at edges where ringing does not occur.

The invention also provides image display devices using the invented image display methods.

DETAILED DESCRIPTION OF THE INVENTION

Figure 1:
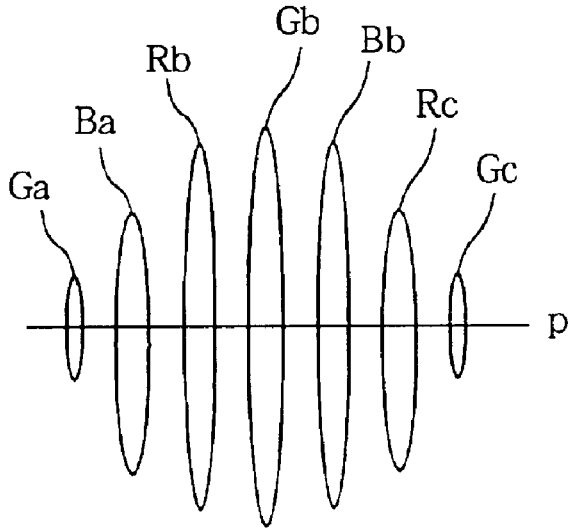
FIG. 1 PRIOR ART
FIG. 1 illustrates a white dot displayed on a CRT.
Figure 2:
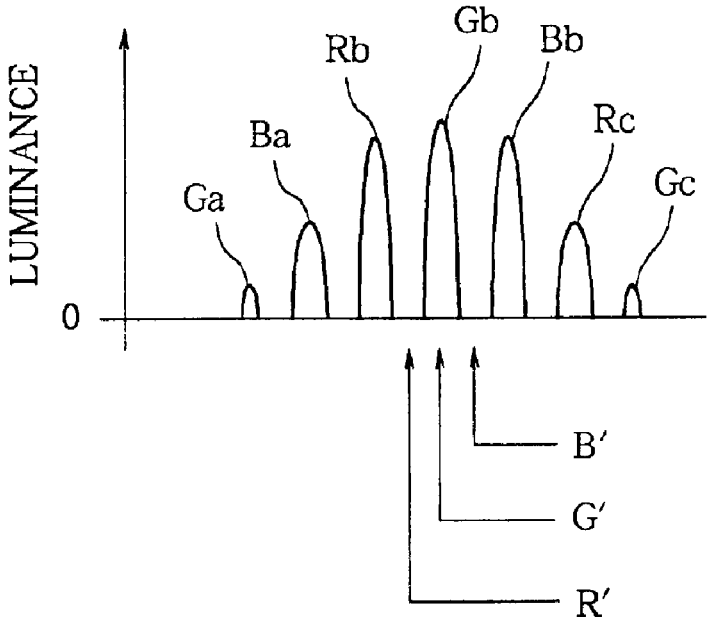
FIG. 2 PRIOR ART
FIG. 2 illustrates the luminance distribution of the white dot in FIG. 1.
Figure 3:
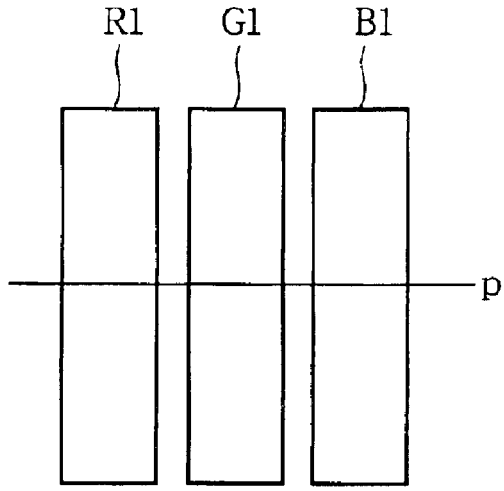
FIG.3 PRIOR ART
FIG. 3 illustrates an LCD pixel.
Figure 4:
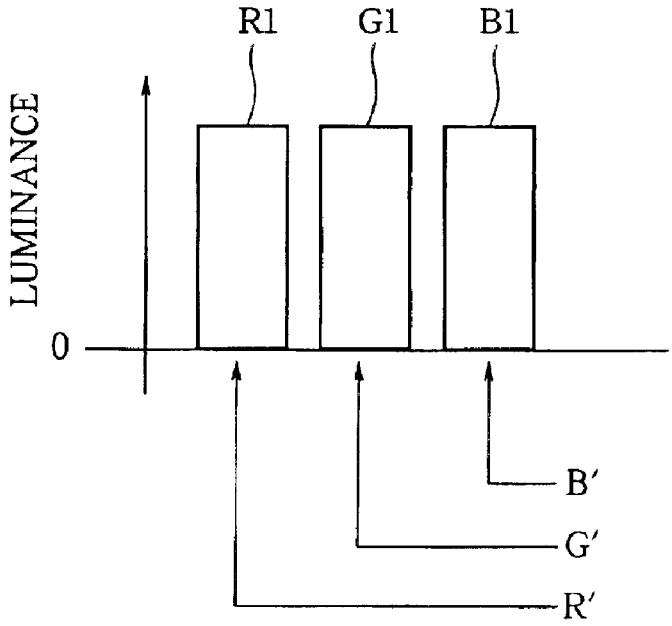
FIG.4 PRIOR ART
FIG. 4 illustrates red, green, and blue luminance centroids of a white dot displayed by an LCD pixel.

Embodiments of the invention will be described with reference to the attached drawings, in which like parts are indicated by like reference characters.

Figure 14:
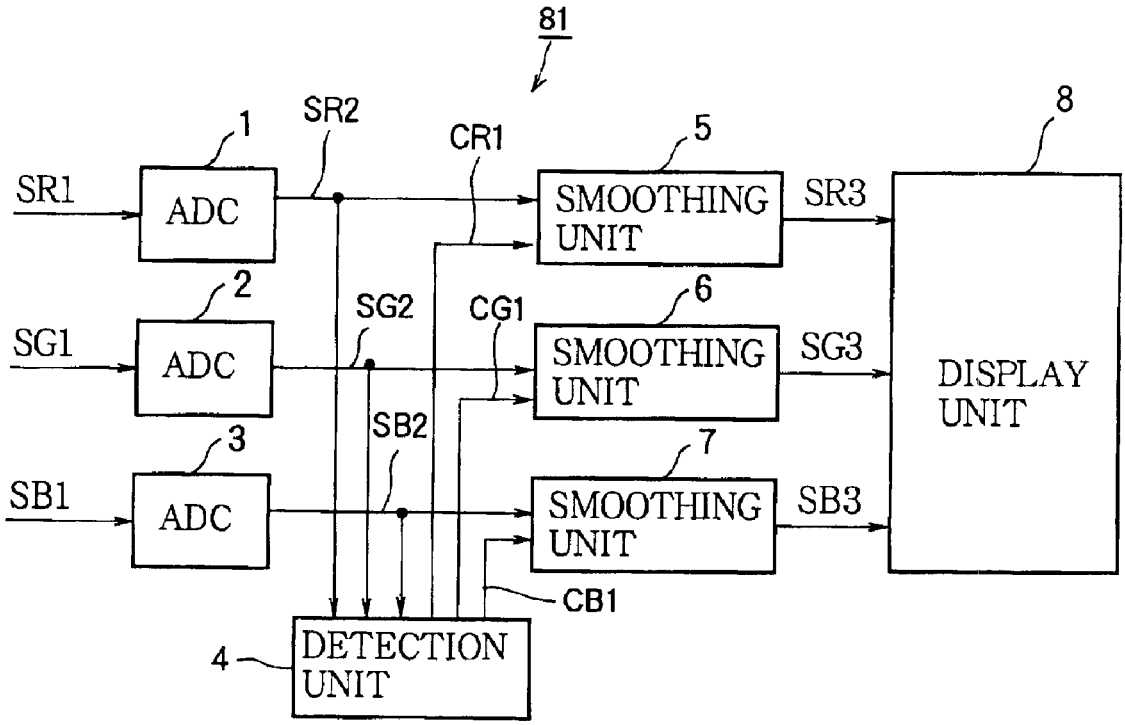
FIGS. 14, 15, 16, and 17 are block diagrams of image display devices illustrating a first embodiment of the invention.

Referring to FIG. 14, a first embodiment of the invention is an image display device 81 comprising analog-to-digital converters (ADCs) 1, 2, 3, a detection unit 4, smoothing units 5, 6, 7, and a display unit 8. The analog-to-digital converters 1, 2, 3 convert analog input signals SR1, SG1, SB1 to digital signals SR2, SG2, SB2 representing red, green, and blue image data, respectively. The detection unit 4 receives these digital signals SR2, SG2, SB2 and generates corresponding control signals CR1, CG1, CB1. The smoothing units 5, 6, 7 filter the digital signals SR2, SG2, SB2 according to the control signals CR1, CG1, CB1. Each smoothing unit comprises, for example, a plurality of internal filters with different filtering characteristics, and a switch that selects one of the internal filters according to the corresponding control signal. The display unit 8 displays the resulting filtered signals SR3, SG3, SB3.

Figure 15:
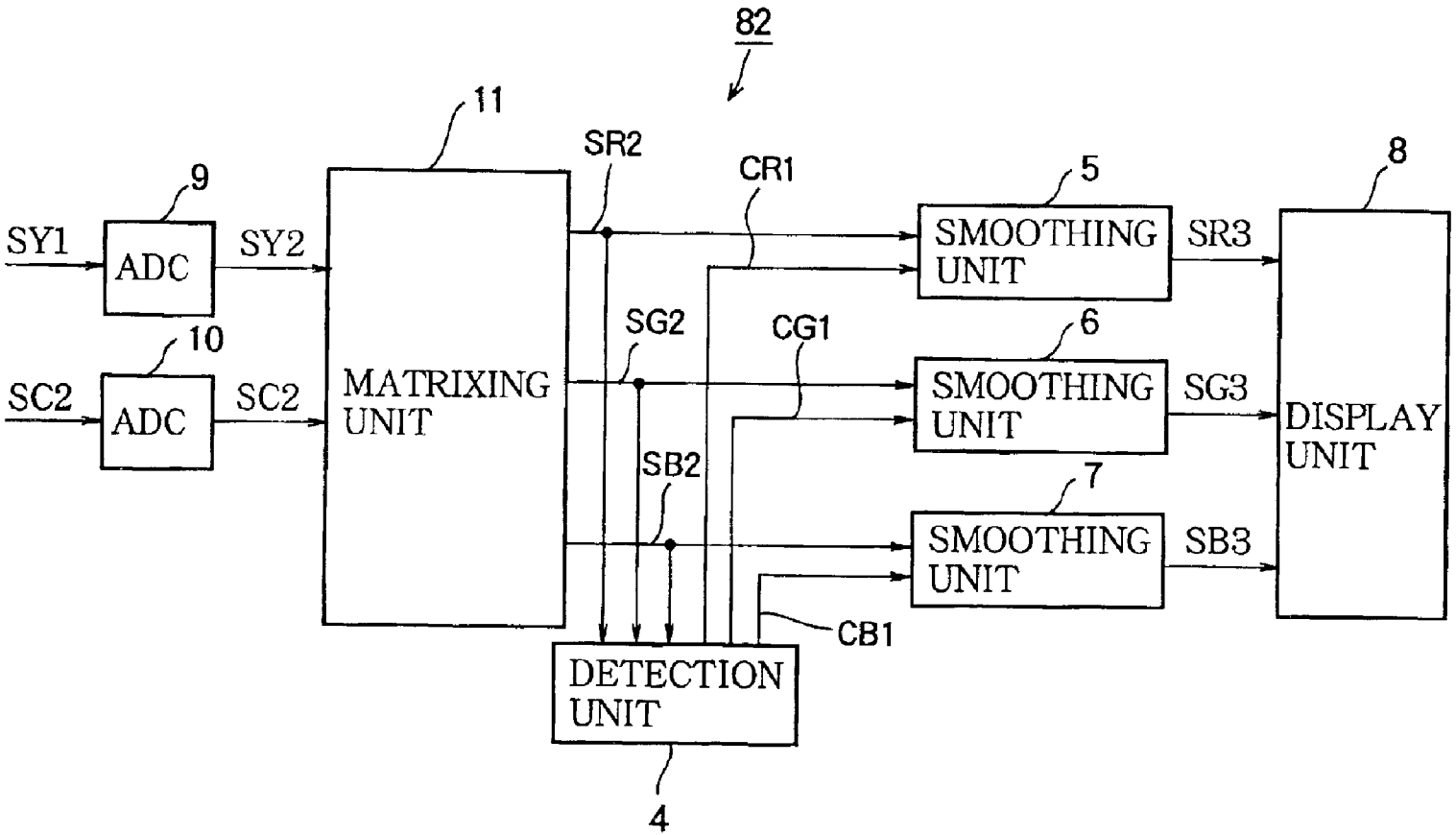

As a variation of the first embodiment, FIG. 15 shows an image display device 82 that receives an analog luminance signal SY1 and an analog chrominance signal SC1 instead of analog red-green-blue input signals. Two analog-to-digital converters 9, 10 convert SY1 and SC1 to a digital luminance signal SY2 and a digital chrominance signal SC2. A matrixing unit 11 converts SY2 and SC2 to digital red, green, and blue image data signals SR2, SG2, SB2, which are processed by a detection unit 4 and smoothing units 5, 6, 7 as in FIG. 14.

Figure 16:
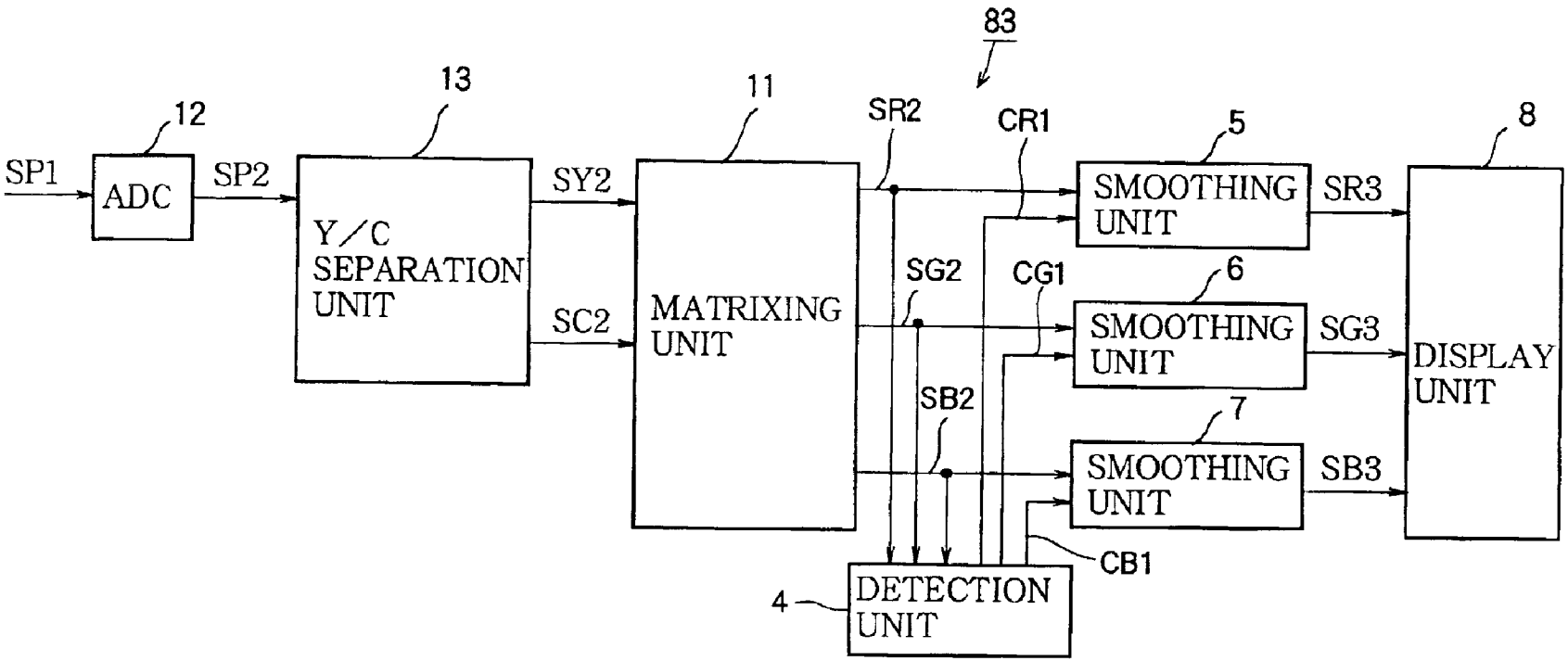

As another variation of the first embodiment, FIG. 16 shows an image display device 83 that receives an analog composite signal SP1 including both luminance and chrominance information. A single analog-to-digital converter 12 converts SP1 to a digital composite signal SP2. A luminance-chrominance (Y/C) separation unit 13 converts SP2 to a digital luminance signal SY2 and a digital chrominance signal SC2. A matrixing unit 11 converts SY2 and SC2 to digital red, green, and blue image data signals SR2, SG2, SB2, which are processed by a detection unit 4 and smoothing units 5, 6, 7 as in FIG. 14.

These image display devices 81, 82, 83 convert analog input signals (red-green-blue input signals, separate luminance and chrominance signals, or a composite signal) to digital signals by sampling the analog signals at a predetermined frequency, and perform further processing as necessary to obtain digital red, green, and blue image data signals that can be processed by the detection unit 4 and smoothing units 5, 6, 7. The first embodiment is not restricted to analog input signals, however.

Figure 17:
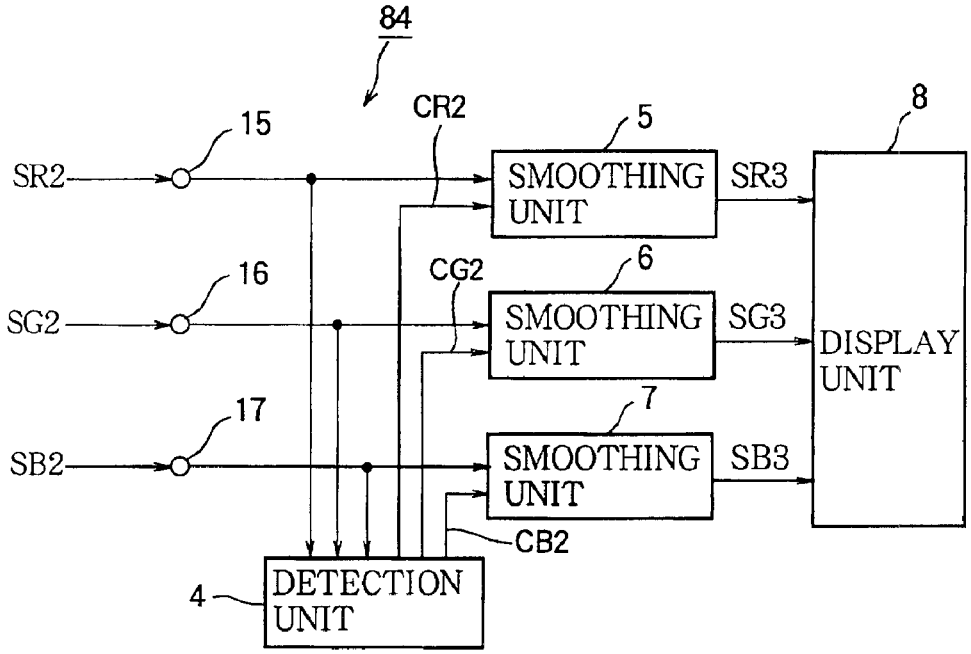

As yet another variation of the first embodiment, FIG. 17 shows an image display device 84 having a digital input terminal 15 that receives digital image data SR1 for the first primary color (red), a digital input terminal 16 that receives digital image data SG1 for the second primary color (green), and a digital input terminal 17 that receives digital image data SB1 for the third primary color (blue). SR2, SG2, and SB2 are digital counterparts of the analog input signals SR1, SG1, SB1 received by the image display device 81 in FIG. 14. Analog-to-digital converters are not needed because the input signals are already digital. The input image data signals SR2, SG2, SB2 are supplied directly to a detection unit 4 and smoothing units 5, 6, 7, which perform the same functions as in the image display device 81 in FIG. 14.

Figure 18:
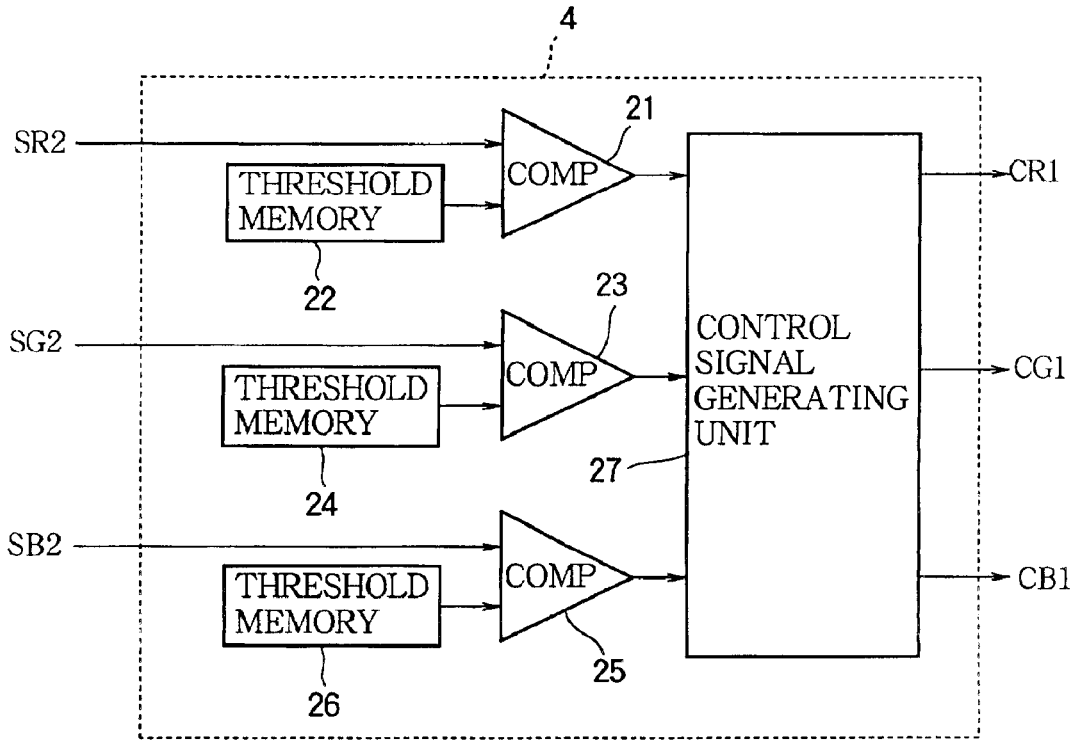
FIG. 18 is a block diagram illustrating the structure of the detection unit in the first embodiment.

FIG. 18 shows the internal structure of the detection unit 4 in FIGS. 14 to 17. Corresponding to the three primary colors represented by the digital image data signals, the detection unit 4 has three comparators (COMP) 21, 23, 25 and three threshold memories 22, 24, 26. The detection unit 4 also has a control signal generating unit 27 comprising a microprocessor or the like that generates the control signals CR1, CG1, CB1.

The detection unit 4 receives digital image data signals SR2, SG2, SB2 representing the three primary colors. The input image data are the same regardless of whether the detection unit 4 is disposed in the image display device 81 that receives analog signals for the three primary colors and digitizes them as in FIG. 14, the image display device 82 that receives analog luminance and chrominance signals SY1, SC1 and digitizes them as in FIG. 15, or the image display device 83 that receives an analog composite signal SP1 and digitizes it as shown FIG. 16. Moreover, the image display devices 82, 83 in FIGS. 15 and 16 may be modified so as to receive digital signals as input image data by eliminating the analog-to-digital converters 9, 10, 12 and providing digital input terminals (not visible) for input of the digital image data.

Referring once again to FIG. 18, the digital image data SR2, SG2, SB2 are supplied to input terminals of respective comparators 21, 23, 25. The comparators 21, 23, 25 also receive corresponding threshold values that are stored in respective threshold memories 22, 24, 26. The comparators 21, 23, 25 execute a comparison process on the digital image data SR2, SG2, SB2 and the threshold values stored in the corresponding threshold memories 22, 24, 26, and supply the results of the comparisons to the control signal generating unit 27. From these comparison results, the control signal generating unit 27 makes decisions, using predetermined values, or values resulting from computational processes or the like, and thereby generates the control signals CR1, CG1, CB1 that are sent to the smoothing units 5, 6, 7 to select the filtering processing carried out therein.

Figure 19:
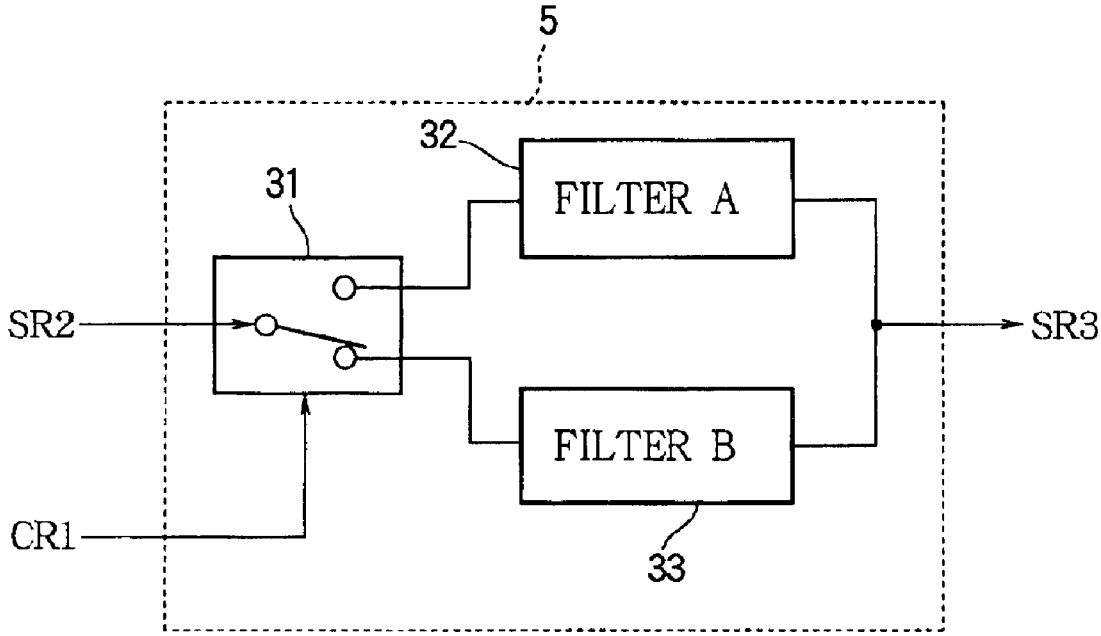
FIG. 19 is a block diagram illustrating the structure of the smoothing units in the first embodiment.

FIG. 19 shows the internal structure of smoothing unit 5 in FIGS. 14 to 17. Smoothing units 6 and 7 have similar structures, drawings of which will be omitted.

Smoothing unit 5 includes a switch 31 and two filters 32, 33. The switch 31 has one input terminal, which receives the red digital image data signal SR1, and two output terminals, which are coupled to respective filters 32, 33. The switch 31 is controlled by the control signal CR1 output from the detection unit 4, which selects one of the two output terminals. The input data SR2 are supplied to the selected output terminal and processed by the connected filter 32 or 33.

The two filters 32, 33 have different filtering characteristics. The filtering characteristic of one of the filters may be a non-smoothing characteristic. For example, when one of the filters is selected, the input data SR2 may simply be output as the output data SR3 without the performance of any smoothing process or other filtering process.

Figure 20:
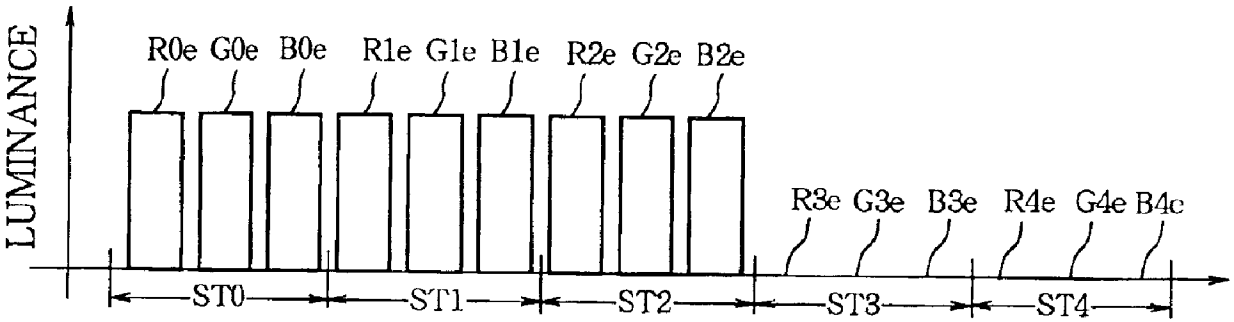
FIGS. 20 and 21 illustrate white-black edges in an image.
Figure 21:
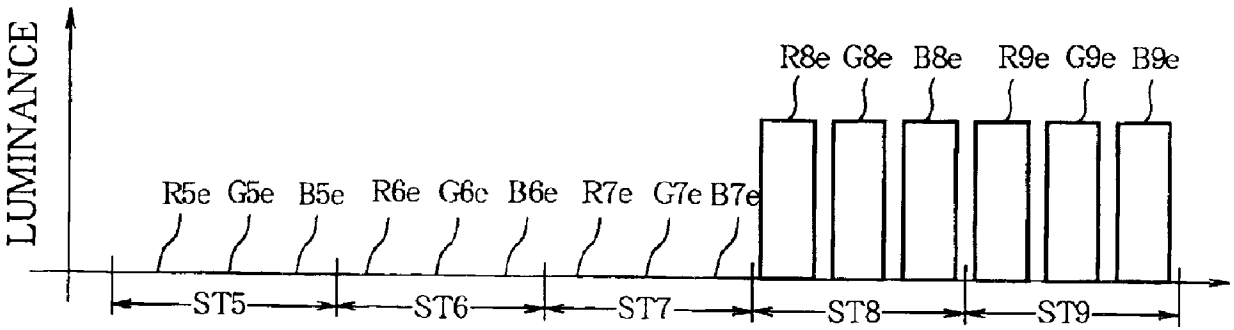

FIGS. 20 and 21 show examples of luminance distributions resulting when image data including a black-white boundary or edge are displayed without being smoothed. Horizontal position is indicated on the horizontal axis, and luminance on the vertical axis. ST0 to ST9 are pixels, R0*e* to R9*e* are the luminance levels of the corresponding red cells, G0*e* to G9*e* are the luminance levels of the corresponding green cells, and B0*e* to B9*e* are the luminance levels of the corresponding blue cells. FIG. 20 illustrates a boundary between a white area on the left and a black area on the right. FIG. 21 illustrates a boundary between a black area on the left and a white area on the right.

In FIG. 20, the detection unit 4 identifies pixels ST0 (R0*e*, G0*e*, B0*e*), ST1 (R1*e*, G1*e*, B1*e*) and ST2 (R2*e*, G2*e*, B2*e*) as belonging to a bright area, and pixels ST3 (R3*e*, G3*e*, B3*e*) and ST4 (R4*e*, G4*e*, B4*e*) as belonging to a dark area.

In FIG. 21, the detection unit 4 identifies pixels ST5 (R5*e*, G5*e*, B5*e*), ST6 (R6*e*, G6*e*, B6*e*) and ST7 (R7*e*, G7*e*, B7*e*) as belonging to a dark area, and pixels ST8 (R8*e*, G38*e*, B8*e*) and ST9 (R9*e*, G9*e*, B9*e*) as belonging to a bright area.

From these results, pixel ST2 (R2*e*, G2*e*, B2*e*) in FIG. 20 and pixel ST8 (R8*e*, G8*e*, B8*e*) in FIG. 21 are detected as bright pixels adjacent to dark areas. The detection unit 4 generates control signals CR1, CG1, CB1 for the smoothing units 5, 6, 7 on the basis of this information.

In the present embodiment, the smoothing units 5, 6, 7 perform selective smoothing processes on the basis of the control signals CR1, CG1, CB1 received from the detection unit 4. At boundaries between bright and dark areas, these control signals select smoothing only for the bright part adjacent to the dark part, whereby dark lines and letters on a bright background can be smoothed so as not to appear too thin, while bright lines and letters on a dark background are not smoothed and therefore do not appear too thick, so that the clarity of the lines and letters is not impaired.

The smoothing of the image according to the control signals output from the detection unit 4 will be described below.

Figure 8:
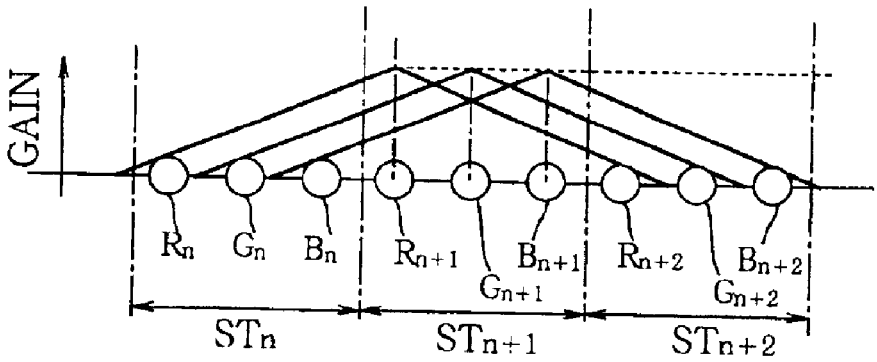
FIG. 8 PRIOR ART
FIG. 8 illustrates the filtering characteristics of the smoothing units in FIG. 7.
Figure 9:
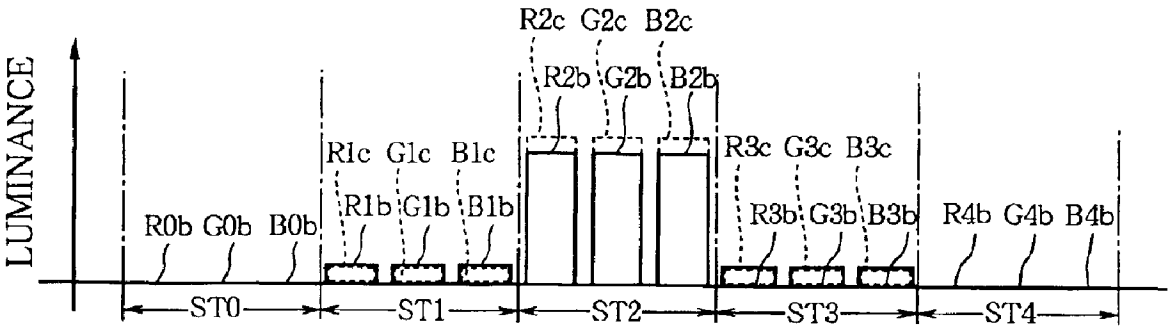
FIG.9 PRIOR ART
FIG. 9 illustrates a white dot or line displayed on a black background with conventional smoothing.
Figure 10:
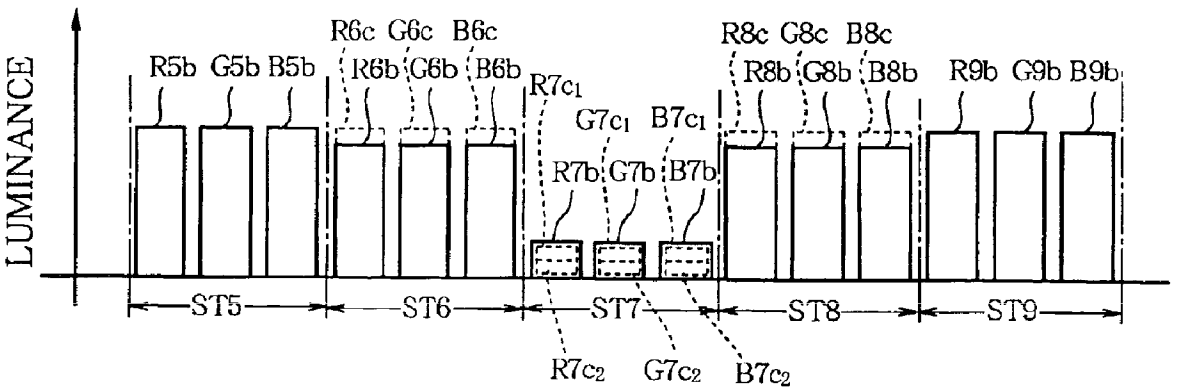
FIG.10 PRIOR ART
FIG. 10 illustrates a black dot or line displayed on a white background with conventional smoothing.
Figure 11:
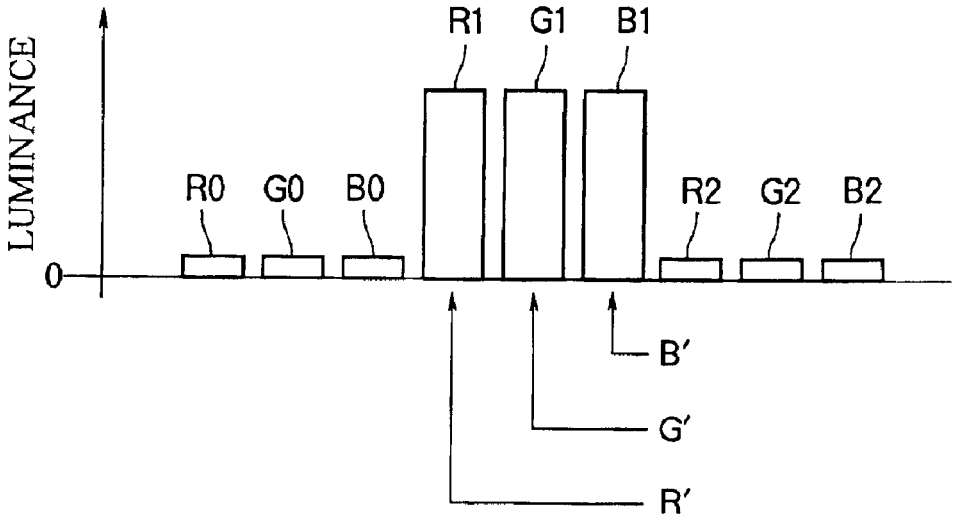
FIG.11 PRIOR ART
FIG. 11 illustrates the positions of red, green, and blue luminance centroids after conventional smoothing.
Figure 22:
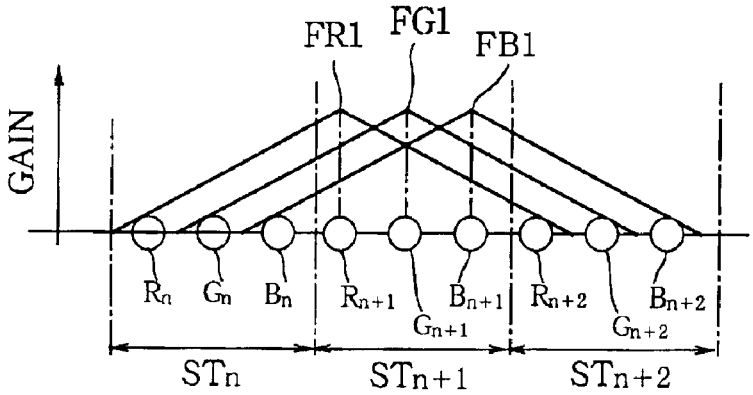
FIGS. 22 and 23 illustrate filtering characteristics used in the first embodiment.

The first filters 32 (filter A) in the smoothing units 5, 6, 7 have the characteristics FR1, FG1, FB1 shown in FIG. 22, which is basically similar to FIG. 8. These filters are used when the detection unit 4 detects a bright part of the image adjacent to a dark part of the image. The filtered luminance levels in pixel STn+1 include large contributions from the unfiltered STn+1 luminance levels and smaller, equal contributions from the unfiltered luminance levels of the adjacent pixels STn, STn+2.

Figure 23:
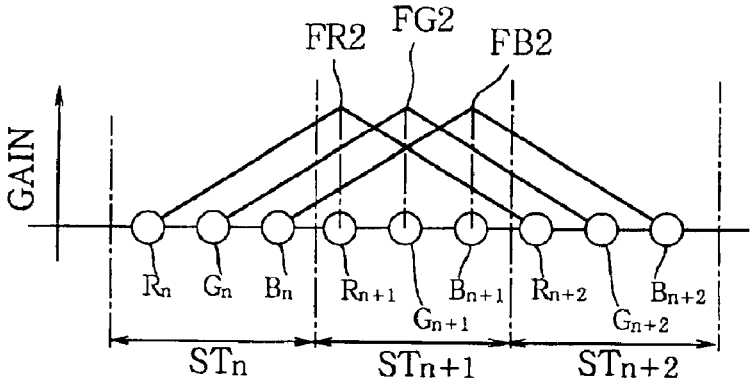

The second filters 33 (filter B) in the smoothing units 5, 6, 7 have the characteristics FR2, FG2, FB2 shown in FIG. 23. These filters are used in parts of the image that are not bright parts adjacent to dark parts. The filtered luminance levels in pixel STn+1 are derived entirely from the unfiltered luminance levels in the same pixel STn+1 with no contributions from the unfiltered luminance levels of the adjacent pixels STn, STn+2. It is simplest to regard filter B as transferring the entire unfiltered data values SR2, SG2, SB2 to the filtered data values SR3, SG3, SB3, and this assumption will be made below. The image data accordingly pass through filter B without being smoothed.

In FIGS. 20 and 21, accordingly, filter A, with the characteristics shown in FIG. 22, is applied to two bright pixels ST2 (R2*e*, G2*e*, B2*e*) and ST8 (R8*e*, G8*e*, B8*e*), and filter B, with the characteristics shown FIG. 23, is applied to the other pixel data. Pixels ST2 (R2*e*, G2*e*, B2*e*) and ST8 (R8*e*, G8*e*, B8*e*) are smoothed by filter A, and the other pixels are not smoothed.

Figure 24:
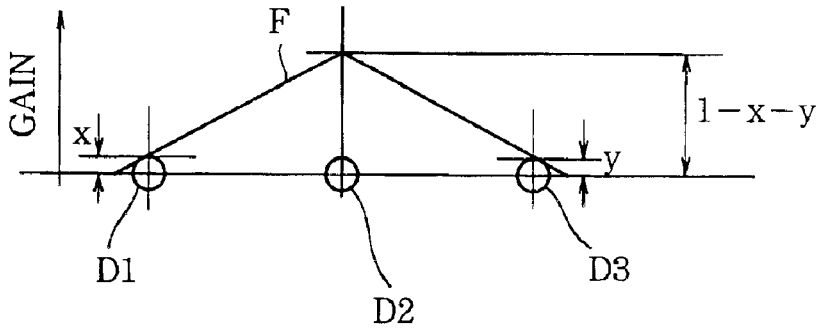
FIG. 24 illustrates gain parameters of the filtering characteristics.

FIG. 24 shows an example of the control of the smoothing units 5, 6, 7 by the detection unit 4. The horizontal axis indicates horizontal position, and the vertical axis indicates gain. D1, D2, and D3 are image data for corresponding colors in three adjacent pixels. The letters x and y indicate gain parameters of the smoothing units 5, 6, 7, which may be specified in the control signals CR1, CG1, CB1. The characteristic F combines D1, D2, and D3 according to the indicated gain coefficients to generate a filtered D2 value. The image data are smoothed when the gain parameters x, y are not both zero. As the gain parameters x, y increase, the degree of smoothing increases.

Specifically, when the detection unit 4 detects a bright part of the image adjacent to a dark part of the image, the smoothing units 5, 6, 7 smooth the image data according to gain parameters satisfying the following conditions.

$$0<x<1,\ 0<y<1,\ x=y,\ \text{and}\ x+y<1$$

For parts not detected by the detection unit 4 as described above, the gain parameters x and y satisfy the following condition.

$$x=y=0$$

Figure 25:
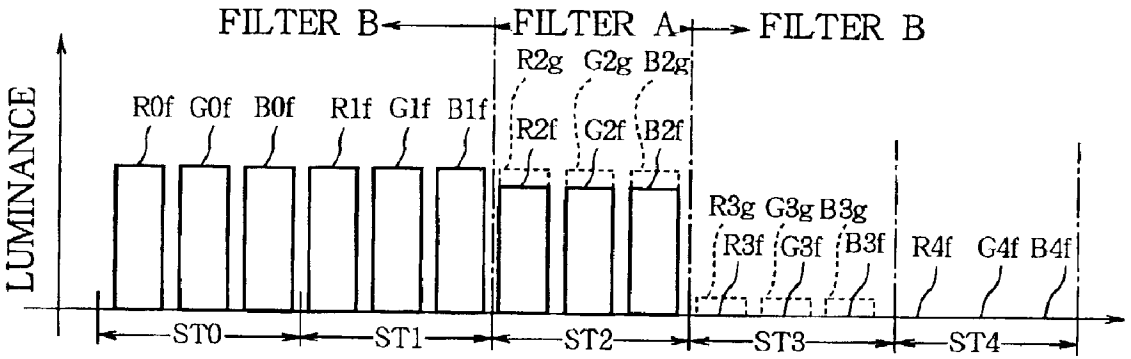
FIGS. 25 and 26 illustrate white-black edges after smoothing in the first embodiment.
Figure 26:
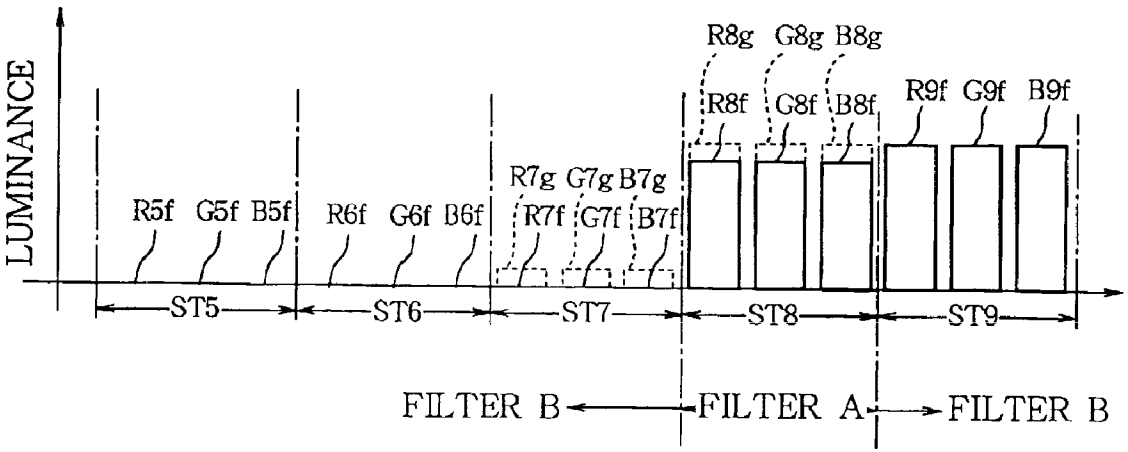

FIGS. 25 and 26 illustrate the operation of the first embodiment on the image data shown in FIGS. 20 and 21. ST0 to ST9 are pixels, R0*f* to R9*f* are the luminance levels of the corresponding red cells, G0*f* to G9*f* are the luminance levels of the corresponding green cells, and B0*f* to B9*f* are the luminance levels of the corresponding blue cells. As explained above, filter A operates on pixels ST2 (R2*f*, G2*f*, B2*f*) and ST8 (R8*f*, G8*f*, B8*f*), and filter B operates on the other pixels.

In FIGS. 25 and 26, the luminance levels in pixels ST2 and ST8 are reduced by amounts R2*g*, G2*g*, B2*g* and R8*g*, G8*g*, B8*g*, but the luminance levels in the adjacent bright pixels ST1 and ST9 are not reduced, and there is no increase in the luminance of the adjacent dark pixels ST3 and ST7. The quantities R3*g*, G3*g*, B3*g* and R7*g*, G7*g*, B7*g* represent increases that would take place in a conventional device using filter A for all pixels, but do not take place in the first embodiment.

The overall operation of the image display device 81 in FIG. 14 will now be described, with reference to FIGS. 14, 18, 19 and 27.

When image signals SR1, SG1, SB1 for three primary colors (red, green, blue) are supplied to analog-to-digital converters 1, 2, 3, they are sampled at a certain frequency corresponding to the image data format and converted to digital image data SR2, SG2, SB2.

Figure 27:
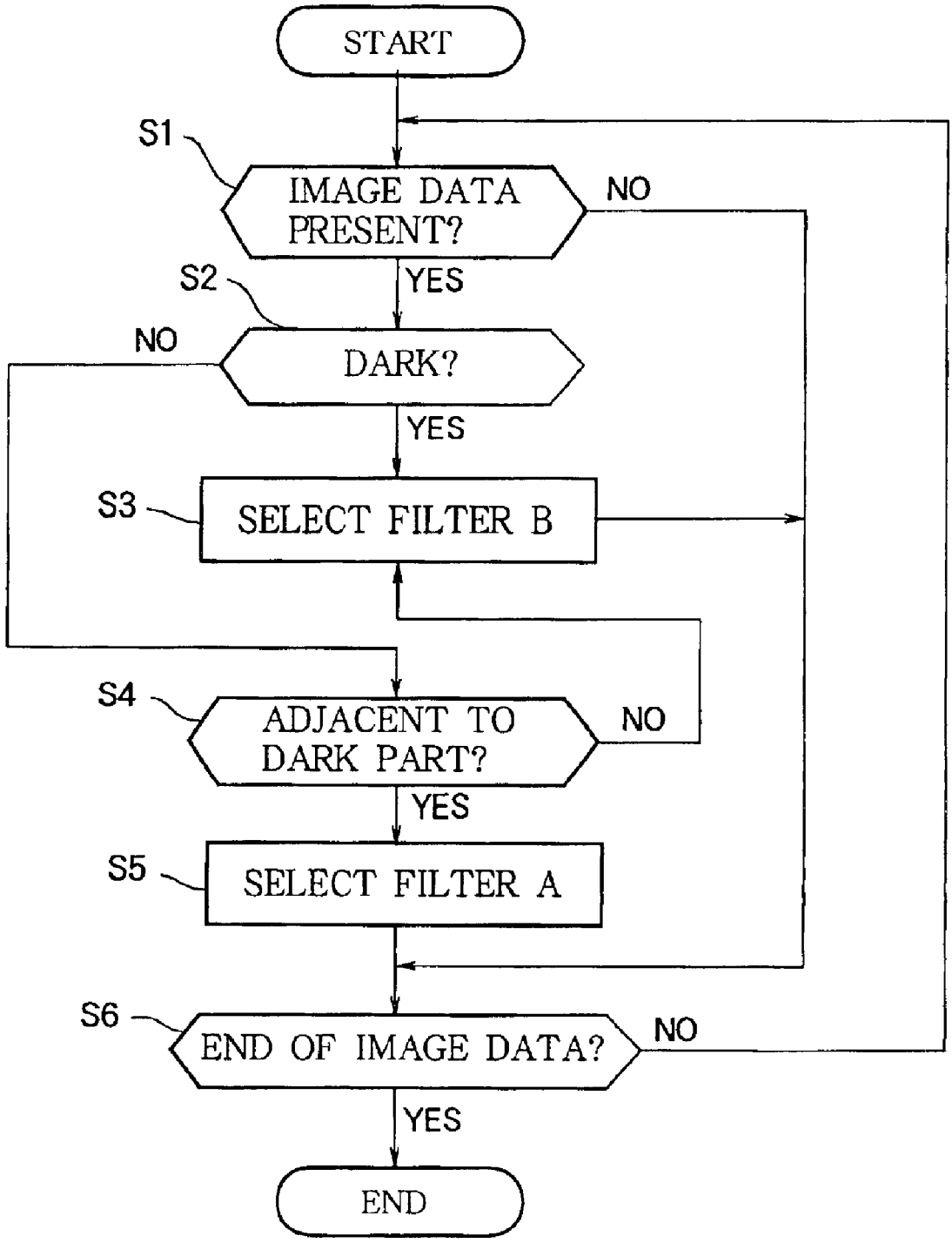
FIG. 27 is a flowchart illustrating the operation of the detection unit in the first embodiment.

The converted image data SR2, SG2, SB2 are furnished to the smoothing units 5, 6, 7 and the detection unit 4, the operation of which is shown in FIG. 27. From the input image data (SR2, SG2, SB2) of the three primary colors, the detection unit 4 detects the presence or absence of image data (step S1). If image data are present (Yes in step S1) the comparators 21, 23, 25 compare the input image data with the threshold values stored in the threshold memories 22, 24, 26 to decide whether the input image data belong to a bright part or a dark part of the image (step S2). If image data are absent (No in step S1), the process jumps to step S6.

If, for example, input image data SR2 belong to a dark part of the image (Yes in step S2), the detection unit 4 uses control signal CR1 to set switch 31 in smoothing unit 5 to the select filter B, the non-smoothing filter, and the image data SR3 resulting from processing by filter B are output from smoothing unit 5 to the display unit 8. Similarly, smoothing units 6, 7 are controlled by control signals CG1, CB1 according to input image data SG2, SB2, and the results of processing by the selected filters are output as image data SG3, SB3. To avoid duplicate description of the processing of input data SR2, SG2, SB2, only the processing of SR2 will be described below.

If the level value of the input image data SR2 exceeds the predetermined threshold value, indicating that SR2 does not belong to a dark part (No in step S2) and thus belongs to a bright part, the detection unit 4 checks the image data preceding and following the input image data SR2 to decide whether SR2 represents a bright part adjacent to a dark part (step S4). If the input image data SR2 represent a bright part adjacent to a dark part (Yes in step S4), a control signal CR1 is sent from the detection unit 4 to smoothing unit 5, calling for selection of filter A, the first filter 32. Switch 31 is controlled by control signal CR1 so as to select the first filter 32 (step S5). Image data SR3 resulting from the filtering process carried out by filter A are then output from smoothing unit 5 to the display unit 8.

If the input image data SR2 do not represent a bright part adjacent to a dark part (No in step S4), a control signal CR1 is sent from the detection unit 4 to smoothing unit 5, calling for the selection of filter B, the second filter 33. Switch 31 is controlled by control signal CR1 so as to select the second filter 33 (step S3). Image data SR3 resulting from the filtering process carried out by filter B are then output from smoothing unit 5 to the display unit 8.

Following step S3 or S6, a decision is made as to whether the image data have ended (step S6). If the image data have ended (Yes in step S6), the processing of the image data ends. If the image data have not ended (No in step S6), the process returns to step S1 to detect more image data.

By operating as described above, the first embodiment is able to execute smoothing processing only on image data for bright parts that are adjacent to dark parts.

Next, the operation of the image display device 82 in FIG. 15 will be described, insofar as it differs from the operation of the image display device 81 in FIG. 14.

The luminance signal SY1 is input to analog-to-digital converter 9, and the chrominance signal SC1 is input to analog-to-digital converter 10. The analog-to-digital converters 9, 10 sample the input luminance signal SY1 and chrominance signal SC1 at a predetermined frequency, and convert these signals to a digital luminance signal SY2 and chrominance signal SC2. The luminance signal SY2 and chrominance signal SC2 output by analog-to-digital converters 9, 10 are input to the matrixing unit 11, and converted to image data SR2, SG2, SB2 for the three primary colors. The image data SR2, SG2, SB2 generated by the matrixing unit 11, are input to the detection unit 4 and the smoothing units 5, 6, 7. A description of subsequent operations will be omitted, as they are similar to operations in the image display unit 81 in FIG. 14.

Next, the operation of the image display device 83 in FIG. 16 will be described, insofar as it differs from the operation of the image display device 81 in FIG. 14.

The composite signal SP1 is input to analog-to-digital converter 12, which samples it at a predetermined frequency, converting the composite signal SP1 to a digital composite signal SP2. The digital composite signal SP2 output from analog-to-digital converter 12 is input to the luminance-chrominance separation unit 13, which separates it into a luminance signal SY2 and a chrominance signal SC2. The luminance signal SY2 and chrominance signal SC2 output by the luminance-chrominance separation unit 13 are input to the matrixing unit 11, and converted to image data SR2, SG2, SB2 for the three primary colors. A description of subsequent operations will be omitted, as they are similar to operations in the image display unit 82 in FIG. 15.

Next, the operation of the image display device 84 in FIG. 17 will be described, insofar as it differs from the operation of the image display device 81 in FIG. 14.

The input digital signals represent the three primary colors. Image data SR2 are input as digital image data for the first color (red) at digital input terminal 15, image data SG2 are input as digital image data for the second color (green) at digital input terminal 16, and image data SB2 are input as digital image data for the third color (blue) at digital input terminal 17. Image data SR2 are supplied to smoothing unit 5 and the detection unit 4, image data SG2 are supplied to smoothing unit 6 and the detection unit 4, and image data SB2 are supplied to smoothing unit 7 and the detection unit 4. A description of subsequent operations will be omitted, as they are similar to operations in the image display unit 81 in FIG. 14.

In the first embodiment as described above, the image data SR2, SG2, SB2 for all three primary colors were compared with respective threshold values stored in the threshold memories 22, 24, 26 in the detection unit 4, but in a variation of the first embodiment, the minimum value among the three image data SR2, SG2, SB2 is found and compared with a threshold value, and if the minimum value is less than the threshold value, the three image data are determined to pertain to a dark part of the image.

The first embodiment reduces the luminance of bright parts of the image that are adjacent to dark parts, without increasing the luminance of dark parts, so it can mitigate the problem of poor visibility of dark lines and letters displayed on a bright background.

Although the first embodiment detects bright parts adjacent to dark parts from the image data SR2, SG2, SB2 of the three primary colors, the invention is not limited to this detection method. It is also possible to detect bright parts adjacent to dark parts from luminance signal data, as in the second embodiment described below.

Figure 28:
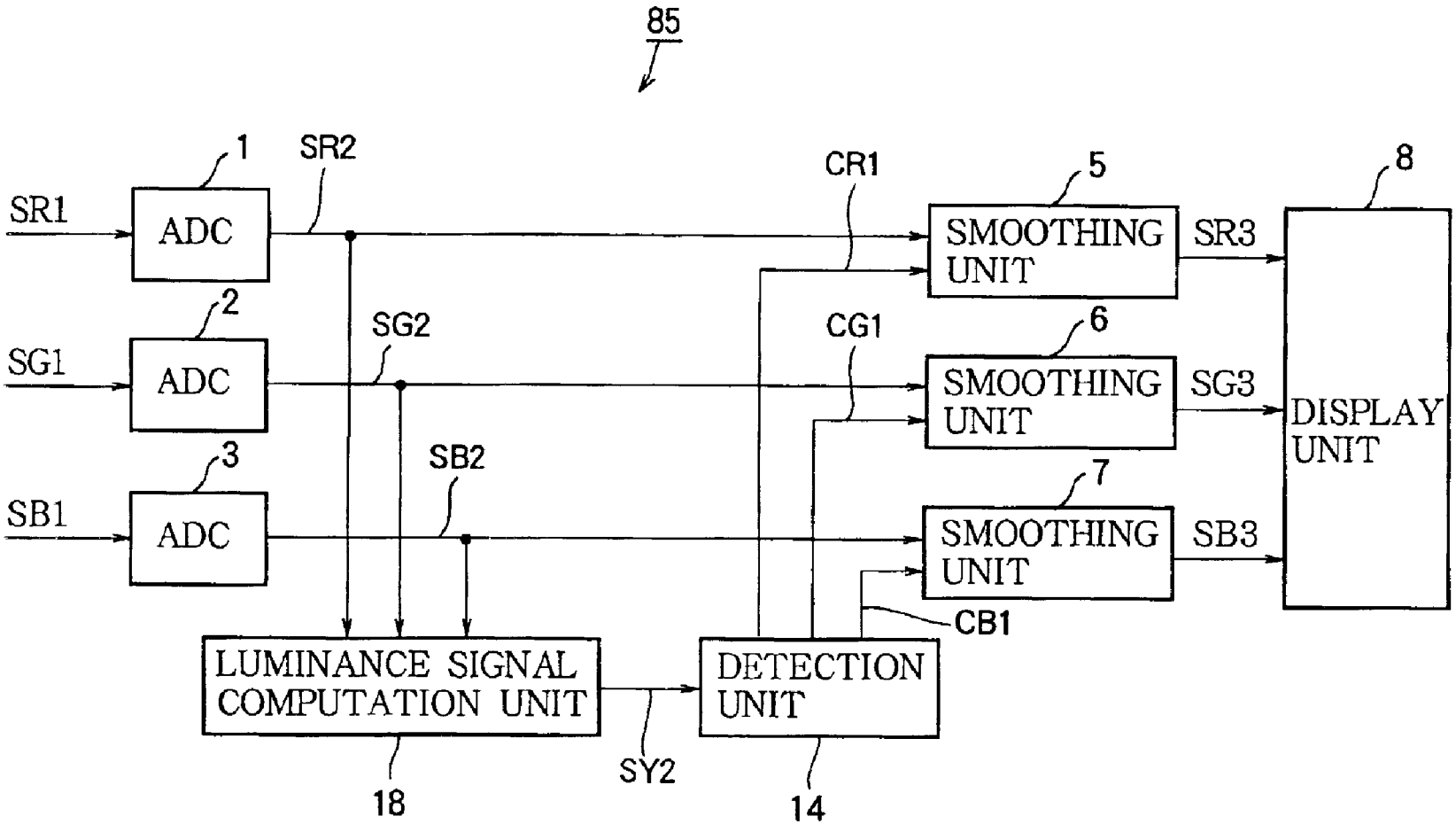
FIGS. 28, 29, and 30 are block diagrams of image display devices illustrating a second embodiment of the invention.

Referring to FIG. 28, the second embodiment is an image display device 85 that differs from the image display device 81 in the first embodiment by the addition of a luminance signal computation unit 18 that calculates a luminance signal SY2 from the image data SR2, SG2, SB2 and outputs the luminance signal SY2 to a detection unit 14, which replaces the detection unit 4 of the first embodiment. The detection unit 14 detects dark parts according to the luminance signal SY2 and generates the control signals CR1, CG1, CB1.

The luminance signal computation unit 18 performs, for example a process reverse to the matrixing process performed by the matrixing unit 11 in the image display devices 82, 83 in FIGS. 15 and 16. Using the image data SR2, SG2, SB2 output from the analog-to-digital converters 1, 2, 3, the detection unit 14 calculates a digital luminance signal SY2. The internal structure of the detection unit 14 will be described later, using FIG. 31.

Figure 29:
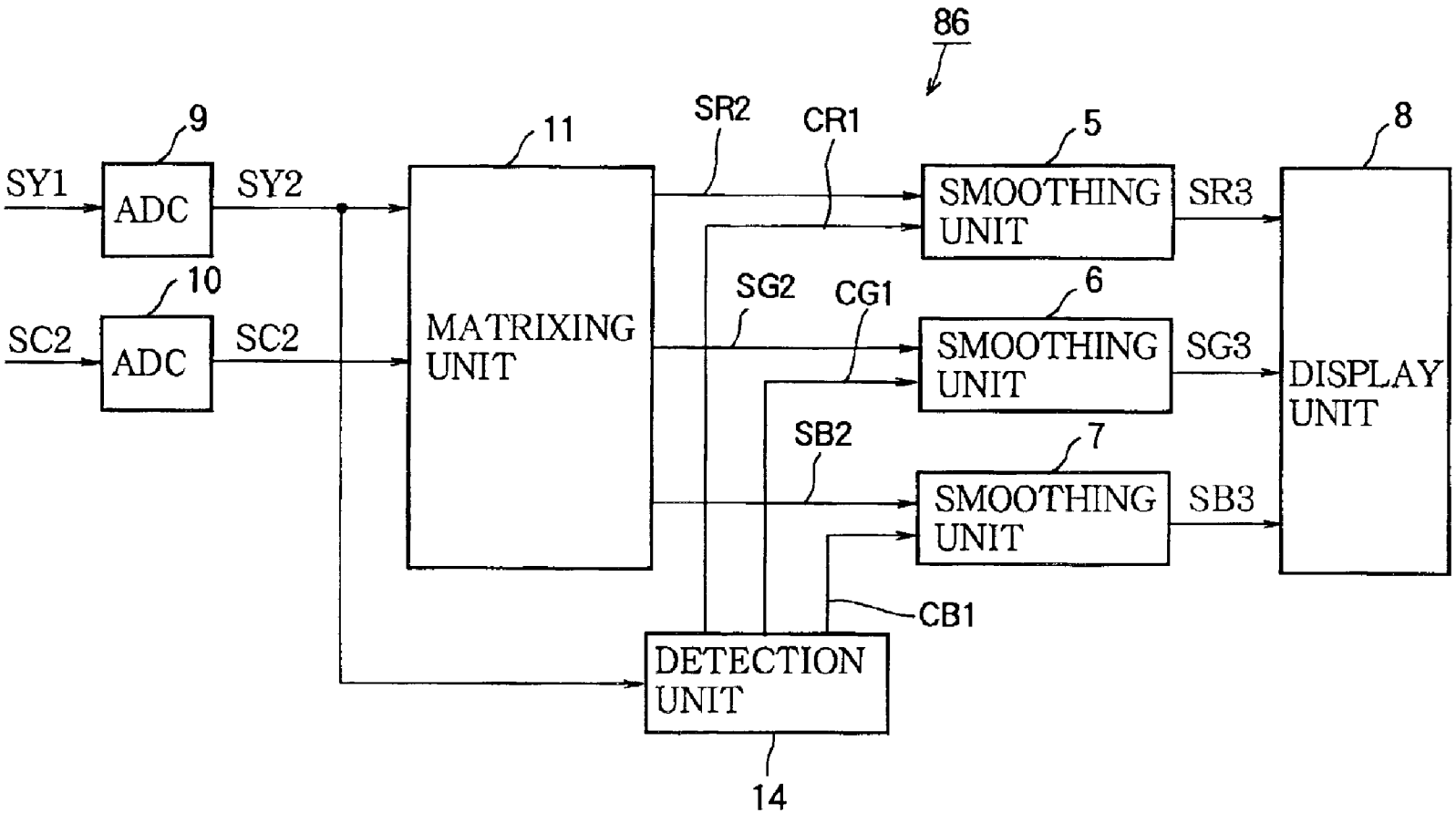

As a variation of the second embodiment, FIG. 29 shows an image display device 86 that receives an analog luminance signal SY1 and an analog chrominance signal SC1 instead of analog red-green-blue input signals. This image display device 86 is similar to the image display device 82 in FIG. 15, except that the detection unit 4 is replaced by a detection unit 14 that receives the digitized luminance signal SY2 directly from analog-to-digital converter 9. This detection unit 14 is identical to the detection unit 14 in the image display device 85. The analog-to-digital converters 9, 10, matrixing unit 11, and smoothing units 5, 6, 7 are similar to the corresponding elements in FIGS. 15 and 28, so further description will be omitted.

Figure 30:
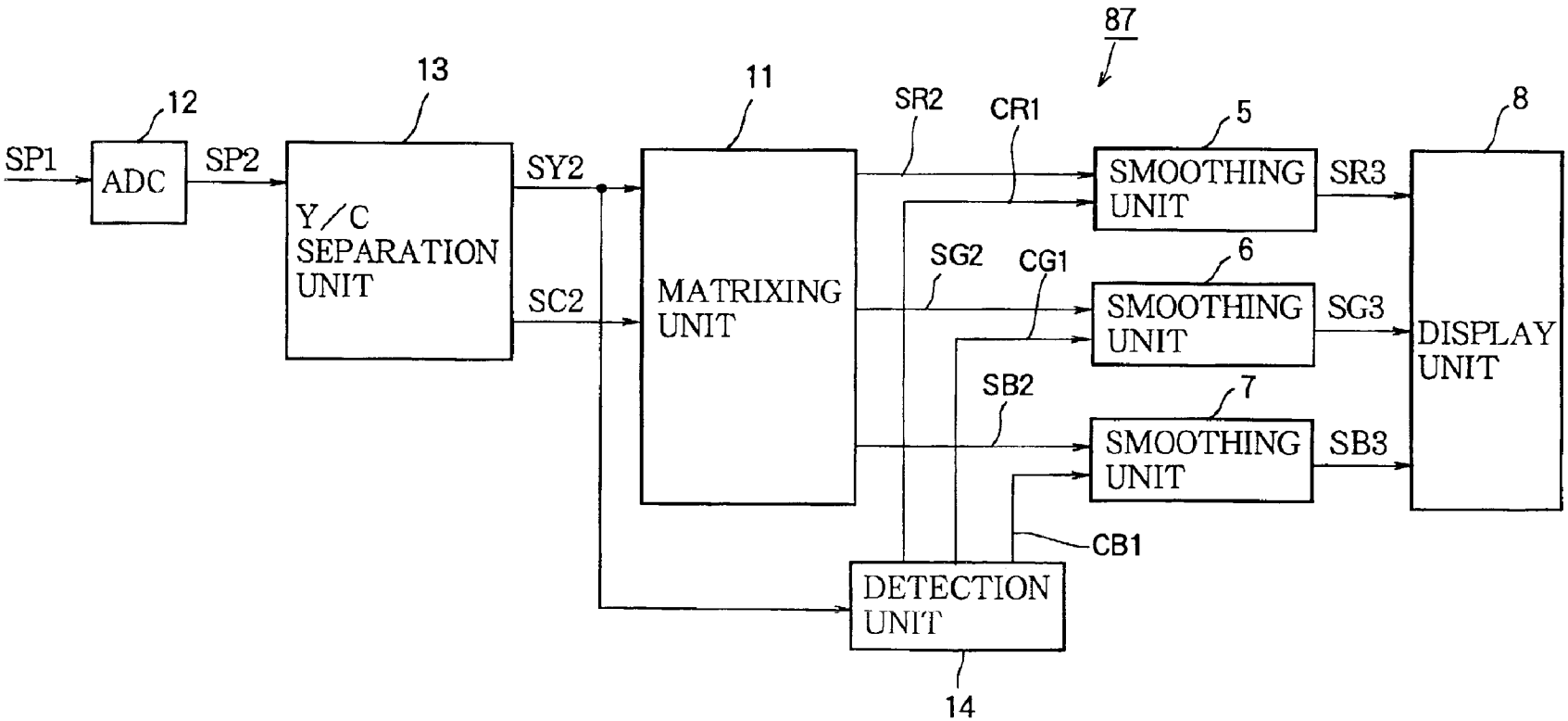

As another variation of the second embodiment, FIG. 30 shows an image display device 87 that receives an analog composite signal SP1. This image display device 87 is similar to the image display device 83 in FIG. 16, except that the detection unit 4 is replaced by a detection unit 14 that receives the digitized luminance signal SY2 output from the luminance-chrominance separation unit 13. This detection unit 14 is identical to the detection unit 14 in the image display device 85. The analog-to-digital converter 12, luminance-chrominance separation unit 13, matrixing unit 11, and smoothing units 5, 6, 7 are similar to the corresponding elements in FIGS. 16 and 28, so further description will be omitted.

Figure 31:
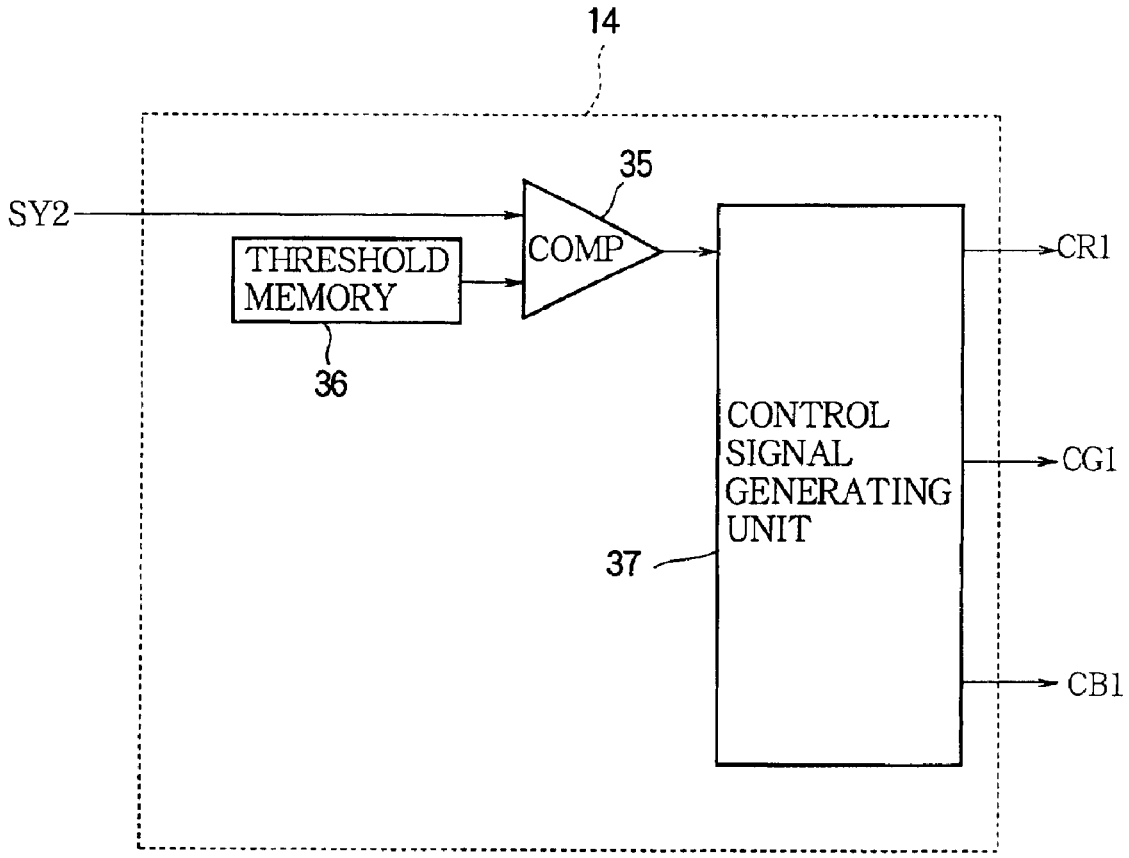
FIG. 31 is a block diagram illustrating the structure of the detection unit in the second embodiment.

FIG. 31 shows the internal structure of the detection unit 14 in FIGS. 28, 29, and 30. The detection unit 14 has a comparator 35 for the digital luminance signal SY2, and a threshold memory 36 that stores a threshold value. The comparator 35 supplies a comparison result to a control signal generating unit 37 comprising a microprocessor or the like that generates the control signals CR1, CG1, CB1. The control signals CR1, CG1, CB1 select filters that execute smoothing processes on the image data SR2, SG2, SB2 for the three primary colors.

Next, the operation of the second embodiment will be described. The only difference between the operation of the first embodiment and the operation of the second embodiment is the difference between the operation of the detection unit 4 in the first embodiment and the detection unit 14 in the second embodiment, so the following description will cover only the operation of the detection unit 14.

In the detection unit 14 in FIG. 31, the luminance signal SY2 is supplied to one input terminal of the comparator 35. The other input terminal of the comparator 35 is connected to the threshold memory 36, and receives a threshold value corresponding to the luminance signal SY2. The comparator 35 compares the luminance signal SY2 with the threshold value stored in the threshold memory 36. The result of the comparison is input to the control signal generating unit 37. From this comparison result, the control signal generating unit 37 makes decisions, using predetermined values, or values resulting from computational processes or the like, and thereby generates the control signals CR1, CG1, CB1 that are sent to the smoothing units 5, 6, 7 to select the filtering processing carried out therein.

When the luminance signal SY2 is less than the predetermined threshold value, the image data SR2, SG2, SB2 corresponding to the luminance signal SY2 are determined to lie in a dark part of the displayed image. Conversely, when the luminance signal SY2 exceeds the predetermined threshold value, the image data SR2, SG2, SB2 corresponding to the luminance signal SY2 are determined to lie in a bright part of the displayed image. From the image data of the dark parts and bright parts as determined above, the detection unit 14 detects bright parts that are adjacent to dark parts as in the first embodiment. Other aspects of the operation are the same as in the first embodiment.

The image display devices of the second embodiment use luminance signal data present or inherent in the image data to detect bright parts of the image that are adjacent to dark parts, and reduce the luminance of these bright parts without increasing the luminance of the adjacent dark parts. The second embodiment, accordingly, can also mitigate the problem of poor visibility of dark lines and letters displayed on a bright background.

Whereas the detection units 4, 14 in the first and second embodiments detected bright parts of the image disposed adjacent to dark parts of the image, the invention can also be practiced by detecting edges in the image, as in the third embodiment described below.

Figure 32:
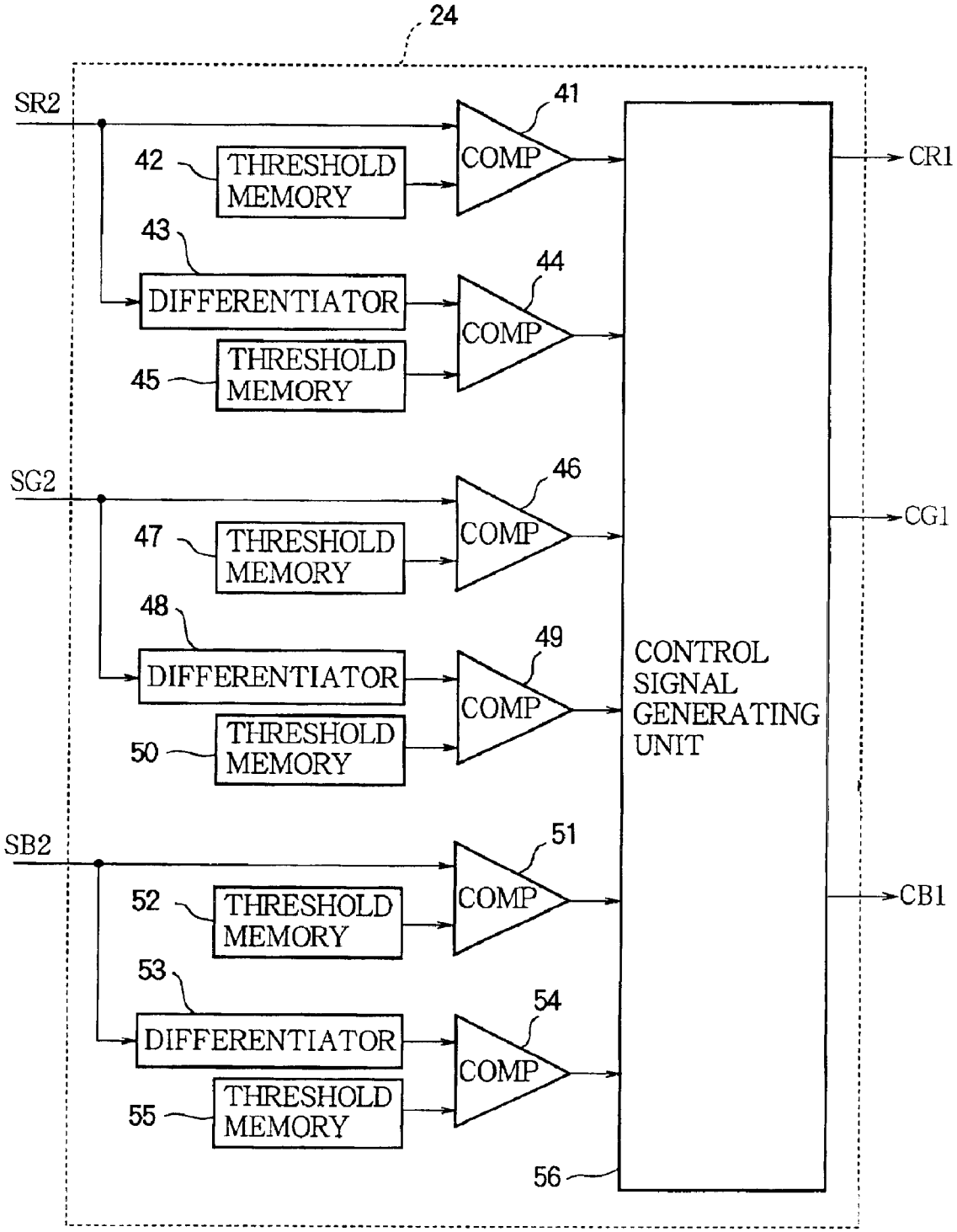
FIG. 32 is a block diagram illustrating the structure of the detection unit in a third embodiment.

The third embodiment replaces the detection unit 4 of the first embodiment with the detection unit 24 shown in FIG. 32. Except for this replacement, the third embodiment is identical to the first embodiment.

The input image data SR2, SG2, SB2 are supplied to respective differentiators 43, 48, 53, the outputs of which are compared with predetermined threshold values by respective comparators 44, 49, 54. The threshold values are stored in respective threshold memories 45, 50, 55. The detection unit 24 has a control signal generating unit 56 that detects dark parts adjacent to bright parts as in the first and second embodiments, and also detects edges in the image from the outputs of the comparators 44, 49, 54. The control signal generating unit 56 generates control signals CR1, CG1, CB1.

In addition, the detection unit 24 has comparators 41, 46, 51 corresponding to the comparators 21, 23, 25 in the first embodiment, and threshold memories 42, 47, 52 corresponding to the threshold memories 22, 24, 26 in the first embodiment.

The detection unit 24 operates to detect bright parts of the image that are adjacent to edges in the image, as described next.

Figure 33:
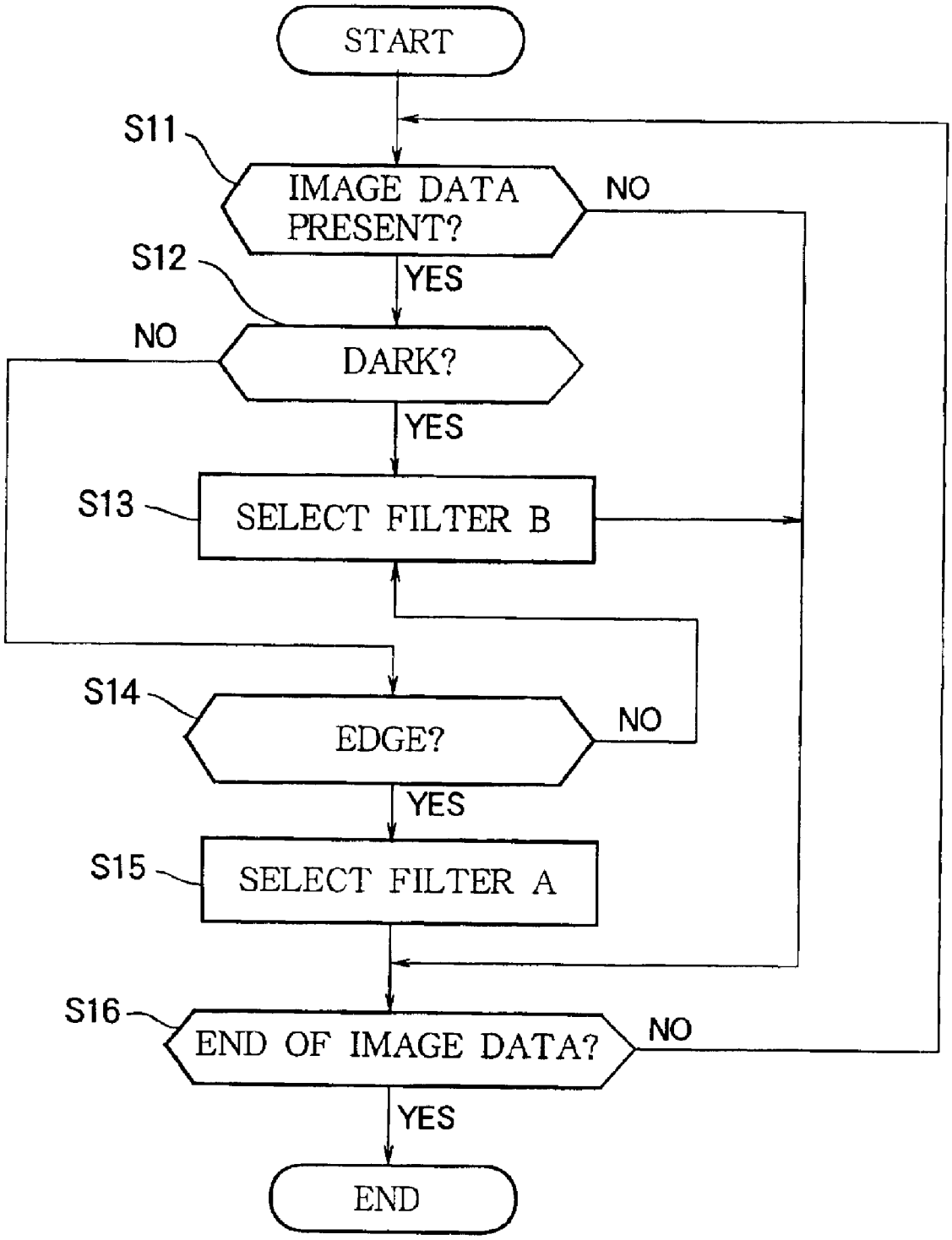
FIG. 33 is a flowchart illustrating the operation of the detection unit in the third embodiment.

The operation of the detection unit 24 is illustrated in flowchart form in FIG. 33. Steps S11 to S13 are similar to steps S1 to S3 in FIG. 27 in the first embodiment. Steps S15 and S16 are similar to steps S5 and S6 in FIG. 27. Descriptions of these steps will be omitted, leaving only step S14 to be described. This step replaces step S4 in the first embodiment.

In step S14, if the decision in step S12 indicates image data belonging to a bright part, a decision is made as to whether the image data are part of an edge. If the image data are part of an edge (Yes in step S14), filter A is selected in step S15. If the image data are not part of an edge (No in step S14), filter B is selected in step S13.

The method by which the detection unit 24 decides whether the image data are part of an edge will now be explained in more detail.

Operating with arbitrary characteristics, the differentiators 43, 48, 53 take first derivatives of the input image data SR2, SG2, SB2 for the three primary colors. The resulting first derivatives are compared in the comparators 44, 49, 54 with the predetermined threshold values, which are stored in the threshold memories 45, 50, 55. If the first derivatives exceed the threshold values, the control signal generating unit 56 recognizes the image data SR2, SG2, SB2 as belonging to an edge in the image, or more precisely, as being adjacent to an edge.

The image data SR2, SG2, SB2 are also compared by comparators 41, 46, 51 with the threshold values stored in threshold memories 42, 47, 52. As in the first and second embodiments, the control signal generating unit 56 recognizes the image data SR2, SG2, SB2 as belonging to a bright part of the image if the outputs of comparators 41, 46, 51 indicate that the image data SR2, SG2, SB2 exceed these threshold values.

By detecting edges and bright parts of the image, the control signal generating unit 56 also detects bright parts that are adjacent to edges. For image data SR2, SG2, SB2 corresponding to a bright part adjacent to an edge, the control signal generating unit 56 sends the smoothing units 5, 6, 7 control signals CR1, CG1, CB1 including the parameters x and y indicated in FIG. 24 in the first embodiment. Further operations are similar to the operation of the first embodiment, so descriptions will be omitted.

The parameters x and y included in the control signals CR1, CG1, CB1 generated when the control signal generating unit 56 detects a bright part of the image adjacent to an edge in the image may have arbitrary values, but these values can be determined from the first derivatives output from the differentiators 43, 48, 53, as described next.

In the detection unit 24, the first derivative is taken for each primary color on the basis of the following pair of transfer functions.

$$H1(z)=1-z^{+1},\ H1(z)\geqq 0$$

$$H2(z)=1-z^{-1},\ H2(z)\geqq 0$$

Next, the larger of the two differentiation results is selected, and the average of the three values selected for the three colors is multiplied by arbitrary coefficients j, k to obtain x and y.

For example, if the differentiation results are rh1 and rh2 for red, gh1 and gh2 for green, and bh1 and bh2 for blue, then x and y are determined as follows.

$$dr=\max(rh1,\ rh2)$$

$$dg=\max(gh1,\ gh2)$$

$$db=\max(bh1,\ bh2)$$

$$x=j\times(dr+dg+db)/3$$

$$y=k\times(dr+dg+db)/3$$

where max (a, b) indicates the larger of a and b.

The above equations show only one example of the way in which the parameters x and y may be calculated. Another method is to select the maximum value, or the minimum value, of the differentiation results for each color and multiply the selected value by a coefficient, instead of taking the average of the selected results of the three colors.

In the description above, the third embodiment detects bright parts adjacent to edges by using predetermined threshold values to detect edges in the image and different predetermined threshold values to detect bright parts in the image, but the third embodiment is not limited to this detection method. Bright parts adjacent to edges can be detected from the first derivatives alone, because at an edge, the bright part has a high luminance value and the dark part has a low luminance value.

In a variation of the third embodiment, a luminance signal SY2 is used in place of the image data SR2, SG2, SB2 of the three primary colors to determine the parameters x, y in the control signals CR1, CG1, CB1. This variation is similar to the second embodiment, except that the luminance signal SY2 is differentiated. The parameters x, y can be determined by comparing SY2 and its first derivative with separate threshold values, or the parameters x and y can be calculated from the first derivative of SY2 alone.

By operating as described above, the third embodiment is able to execute smoothing processing only on image data representing bright parts of the image that are adjacent to edges in the image.

In the first three embodiments, the detection unit identified dark parts of the image on the basis of a predetermined threshold value and detected bright parts adjacent to the dark parts, or detected bright parts adjacent to edges but the invention is not limited to these detection methods. An alternative method is to detect bright parts disposed adjacent to narrow dark parts, as in the fourth embodiment described below.

Figure 34:
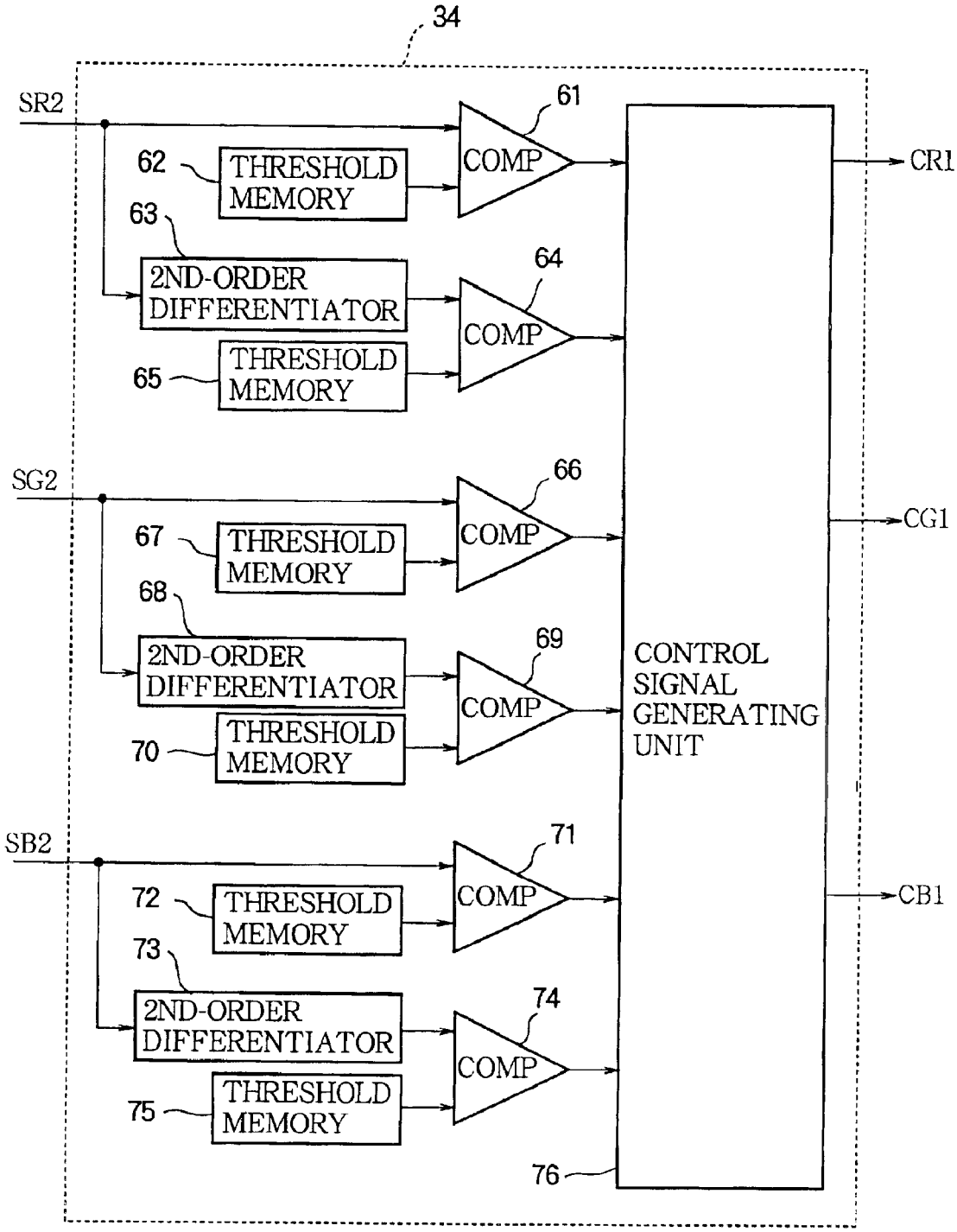
FIG. 34 is a block diagram illustrating the structure of the detection unit in a fourth embodiment.

The fourth embodiment replaces the detection unit 4 of the first embodiment with the detection unit 34 shown in FIG. 34. Except for this replacement, the third embodiment is identical to the first embodiment.

The detection unit 34 in FIG. 34 differs from the detection unit 24 of the third embodiment, shown in FIG. 32, by taking second derivatives instead of first derivatives. Accordingly, the detection unit 34 has second-order differentiators 63, 68, 73 that take the second derivatives of the input image data SR2, SG2, SB2, and a control signal generating unit 76 that detects bright parts that are adjacent to dark parts of the image having a certain arbitrary width or less.

The detection unit 34 also has comparators 61, 64, 66, 69, 71, 74 and threshold memories 62, 65, 67, 70, 72, 75 that correspond to the comparators 41, 44, 46, 49, 51, 54 and threshold memories 42, 45, 47, 50, 52, 55 of the detection unit 24 in the third embodiment, shown in FIG. 32.

Figure 5:
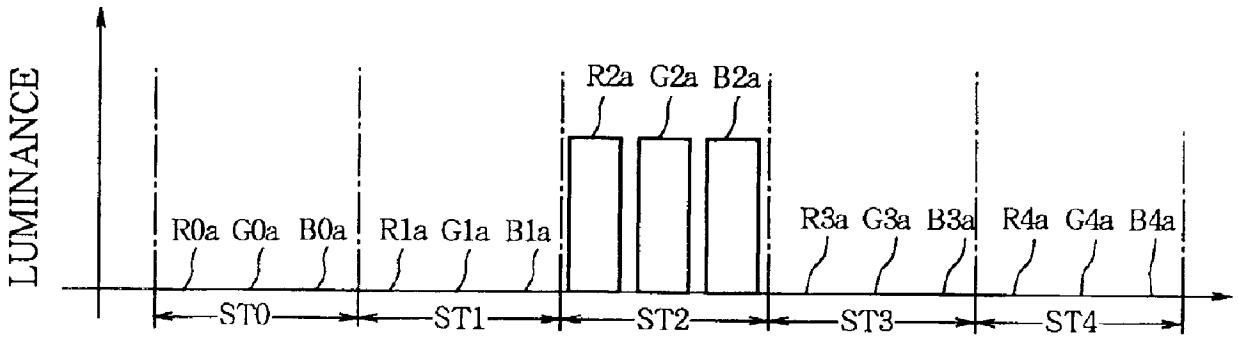
FIG. 5 PRIOR ART
FIG. 5 illustrates a white dot or line displayed on a black background without smoothing.
Figure 6:
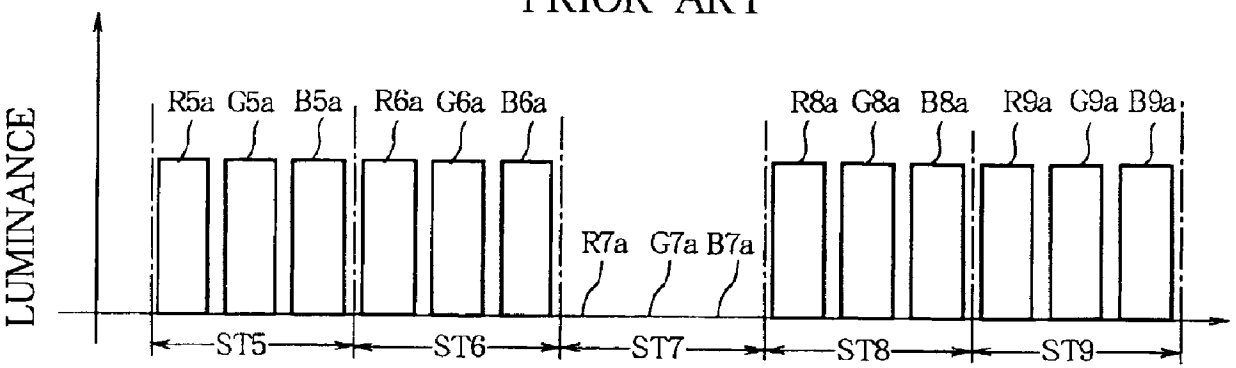
FIG. 6 PRIOR ART
FIG. 6 illustrates a black dot or line displayed on a white background without smoothing.
Figure 7:
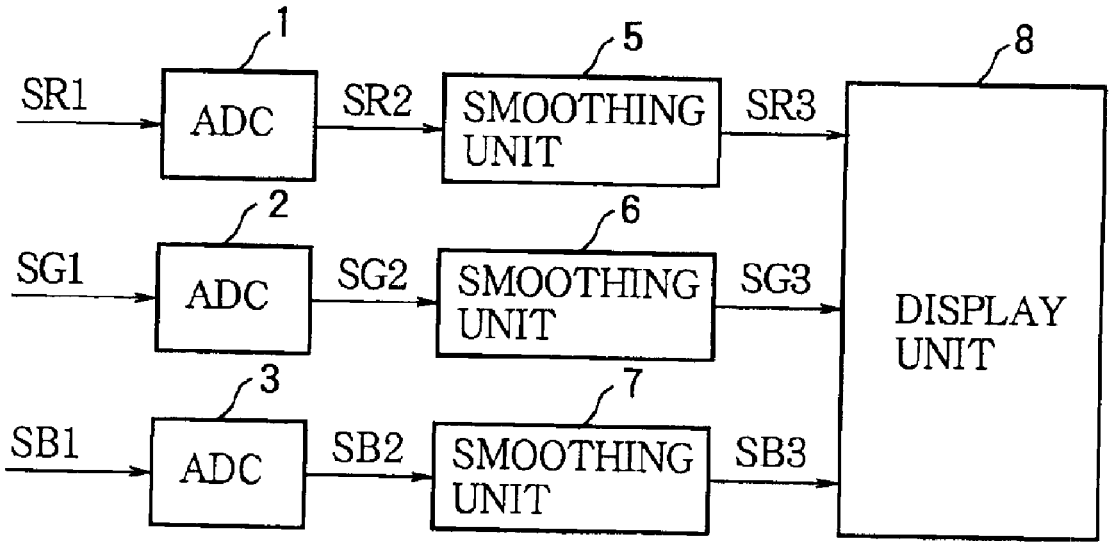
FIG. 7 PRIOR ART
FIG. 7 is a block diagram of a conventional image display device.
Figure 35:
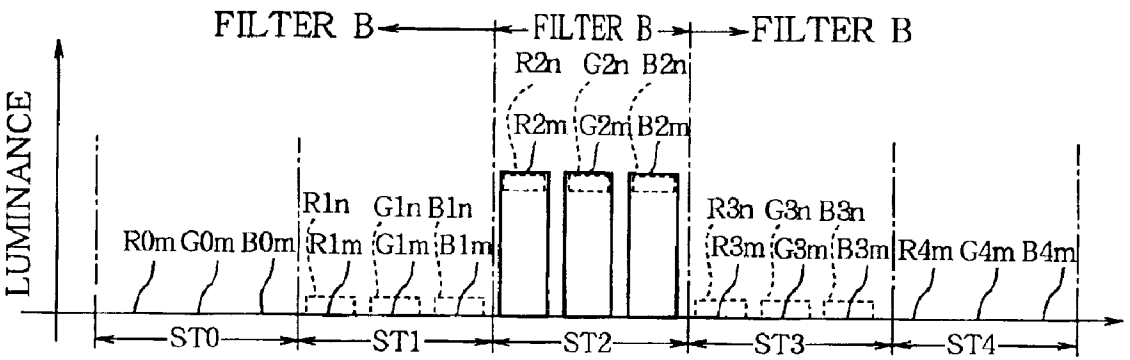
FIG. 35 illustrates a white dot displayed on a black background by the fourth embodiment.
Figure 36:
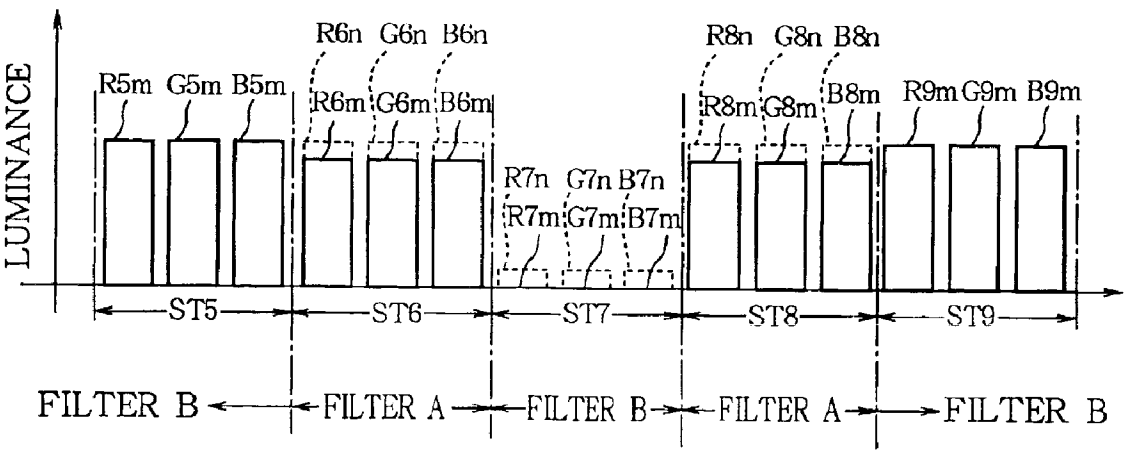
FIG. 36 illustrates a black dot displayed on a white background by the fourth embodiment.

FIGS. 35 and 36 illustrate the results of smoothing the image data shown in FIGS. 5 and 6 according to the fourth embodiment. ST0 to ST9 are pixels, R0*m* to R9*m* are the luminance levels of the corresponding red cells, G0*m* to G9*m* are the luminance levels of the corresponding green cells, and B0*m* to B9*m* are the luminance levels of the corresponding blue cells.

In FIG. 35, neither pixels ST0 (R0*m*, G0*m*, B0*m*) and ST1 (R1*m*, G1*m*, B1*m*) nor pixels ST3 (R3*m*, G3*m*, B3*m*) and ST4 (R4*m*, G4*m*, B4*m*) are adjudged to constitute dark areas having certain arbitrary widths or less, so the smoothing units 5, 6, 7 do not execute smoothing processes on any of the pixels ST0 to ST4. The luminance levels in pixel ST2 are not decreased by amounts R2*n*, G2*n*, B2*n*, and the luminance levels in pixels ST1 and ST3 are not increased by amounts R1*n*, G1*n*, B1*n* and R3*n*, G3*n*, B3*n*.

In FIG. 36, pixel ST7 (R7*m*, G7*m*, B7*m*) is determined to constitute a dark area having a certain arbitrary width or less, so the adjacent pixels ST6 (R6*m*, G6*m*, B6*m*) and ST8 (R8*m*, G8*m*, B8*m*) are smoothed by the smoothing units 5, 6, 7, their luminance levels being decreased by amounts R6*n*, G6*n*, B6*n* and R8*n*, G9*n*, B8*n*, respectively. The luminance levels in pixel ST7 are not increased by amounts R7*n*, G7*n*, B7*n*.

Next, the operation of the detection unit 34 in detecting a bright part of the image adjacent to a dark part of a certain arbitrary width or less will be described.

Figure 37:
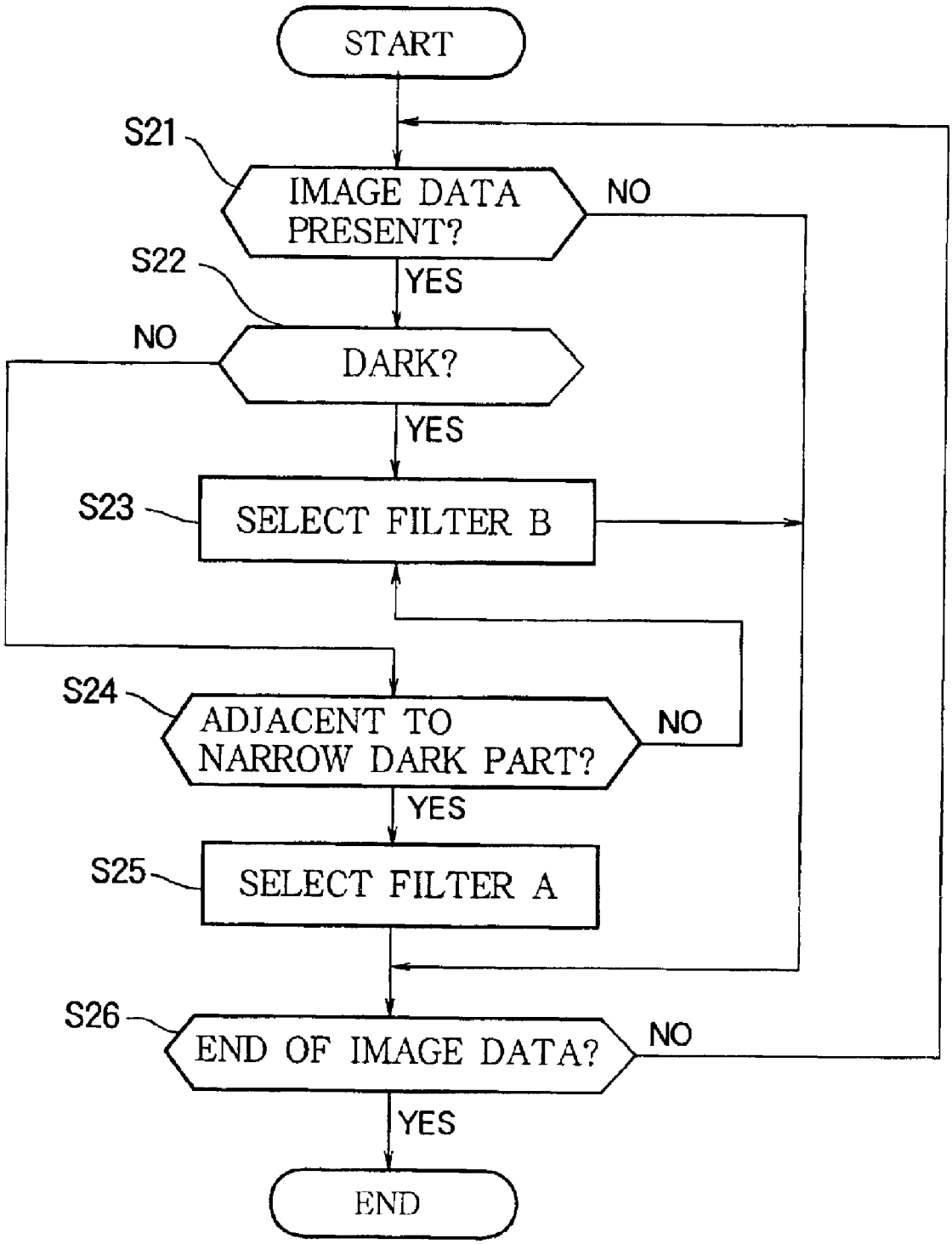
FIG. 37 is a flowchart illustrating the operation of the detection unit in the fourth embodiment.

The operation of the detection unit 34 is illustrated in flowchart form in FIG. 37. Steps S21 to S23 are similar to steps S1 to S3 in FIG. 27 in the first embodiment. Steps S25 and S26 are similar to steps S5 and S6 in FIG. 27. Descriptions of these steps will be omitted, leaving only step S24 to be described. This step replaces step S4 in the first embodiment.

In step S24, if the decision in step S22 indicates image data belonging to a bright part, a decision is made as to whether the image data are adjacent to a dark part of the image having a certain arbitrary width or less. If the image data are adjacent to a dark part of the image having a certain arbitrary width or less (Yes in step S24), filter A is selected in step S25. If the image data are not adjacent to a dark part of the image having a certain arbitrary width or less (No in step S24), filter B is selected in step S23.

The method by which the detection unit 34 decides whether the image data are adjacent to a dark part of the image having a certain arbitrary width or less will now be explained in more detail.

Operating with arbitrary characteristics, the differentiators 63, 68, 73 take second derivatives of the input image data SR2, SG2, SB2 for the three primary colors. The resulting second derivatives are compared in the comparators 64, 69, 74 with predetermined threshold values, which are stored in the threshold memories 65, 70, 75. If the first derivatives exceed the threshold values, the control signal generating unit 76 recognizes the image data SR2, SG2, SB2 as being adjacent to a dark part of the image having a certain arbitrary width or less.

The image data SR2, SG2, SB2 are also compared by comparators 61, 66, 71 with the threshold values stored in threshold memories 62, 67, 72. As in the first and second embodiments, the control signal generating unit 76 recognizes the image data SR2, SG2, SB2 as belonging to a bright part of the image if the outputs of comparators 61, 66, 71 indicate that the image data SR2, SG2, SB2 exceed the threshold values.

By recognizing bright parts of the image and parts that are adjacent to a dark part of the image having a certain arbitrary width or less, the control signal generating unit 76 detects bright parts of the image that are adjacent to dark parts having a certain arbitrary width or less. For image data SR2, SG2, SB2 corresponding to a bright part adjacent to a dark part of the image having this width or less, the control signal generating unit 76 sends the smoothing units 5, 6, 7 control signals CR1, CG1, CB1 including the parameters x and y indicated in FIG. 24 in the first embodiment. Further operations are similar to the operation of the first embodiment, so descriptions will be omitted.

The fourth embodiment mitigates the problem of thinning when dark lines and letters are displayed on a bright background and the problem of the loss of edge sharpness.

The parameters x and y included in the control signals CR1, CG1, CB1 generated when the control signal generating unit 76 detects a bright part of the image adjacent to a dark part of the image having a certain arbitrary width or less may have arbitrary values, but these values can be determined from the second derivatives output from the second-order differentiators 63, 68, 73, as described next.

In the detection unit 34, the second derivative is taken for each color on the basis of the following pair of transfer functions.

$$H3(z)=(1+z^{-2})/2-z^{-1},\ H3(z)\geqq 0$$

$$H4(z)=(1+z^{+2})/2-z^{+1},\ H4(z)\geqq 0$$

Next, the larger of the two differentiation results is selected, and the average of the three values selected for the three colors is multiplied by arbitrary coefficients j, k to obtain x and y.

For example, if the differentiation results are rh3 and rh4 for red, gh3 and gh4 for green, and bh3 and bh4 for blue, then x and y are determined as follows.

$$dr=\max(rh3,\ rh4)$$

$$dg=\max(gh3,\ gh4)$$

$$db=\max(bh3,\ bh4)$$

$$x=j\times(dr+dg+db)/3$$

$$y=k\times(dr+dg+db)/3$$

where max (a, b) again indicates the larger of a and b.

The above equations show only one example of the way in which the parameters x and y may be calculated. Another method is to select the maximum value, or the minimum value, of the differentiation results for each color and multiply the selected value by a coefficient, instead of taking the average of the selected results of the three colors.

In the description above, the fourth embodiment detects bright parts adjacent to a dark part of the image having a certain arbitrary width or less by using predetermined threshold values to detect dark parts of the image having a certain arbitrary width or less, and different predetermined threshold values to detect bright parts in the image, but the fourth embodiment is not limited to this detection method. The narrower the dark part is and the brighter the adjacent bright parts are, the larger the second derivative becomes, so bright parts adjacent to a dark part of the image having a certain arbitrary width or less can be detected from the second derivatives alone.

In a variation of the fourth embodiment, a luminance signal SY2 is used in place of the image data SR2, SG2, SB2 of the three primary colors to determine the parameters x, y in the control signals CR1, CG1, CB1. This variation is similar to the second embodiment, except that the second derivative of the luminance signal SY2 is taken. The parameters x, y can be determined by comparing SY2 and its second derivative with separate threshold values, or the parameters x and y can be calculated from the second derivative of SY2 alone.

In taking the second derivatives of the image data SR2, SG2, SB2 or luminance signal SY2, the fourth embodiment is not limited to use of the transfer functions H3(z) and H4(z) given above.

By operating as described above, the fourth embodiment is able to execute smoothing processing only on image data for bright parts of the image that are adjacent to a dark part of the image having a certain arbitrary width or less. The fourth embodiment can accordingly reduce the luminance of such bright parts without increasing the luminance of the adjacent narrow dark parts, mitigating the problem of the thinning of dark lines and letters displayed on a bright background.

In the preceding description, the second derivative was used to detect bright parts of the image adjacent to dark parts of a certain arbitrary width or less, but other detection methods are possible. For example, dark parts and bright parts can be identified by threshold values as in the first embodiment, and the widths of the dark parts can be measured to identify those having a certain arbitrary width or less, after which the bright parts adjacent to the dark parts having that certain arbitrary width or less can be detected.

Dark parts of the image having a certain arbitrary width or less can also be identified by comparing them with a plurality of binary patterns, after which the bright parts adjacent to the dark parts having a certain arbitrary width or less can be detected.

In the preceding four embodiments, the filters A and B in the smoothing units 5, 6, 7 had the filtering characteristics shown in FIGS. 22 and 23, but the invention can also be practiced with filters having different characteristics for each primary color, as in the fifth embodiment described below.

The fifth embodiment has the same structure as the first embodiment, but replaces filter A in the smoothing units 5, 6, 7 with various smoothing filters having different characteristics. These filters will be referred to generically as filter C.

Figure 38:
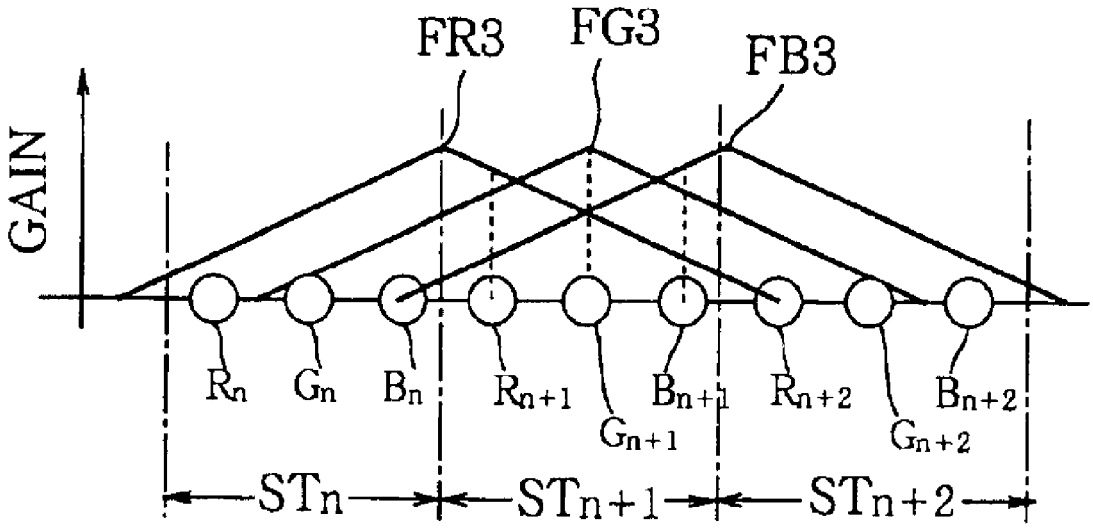
FIG. 38 illustrates filtering characteristics used in a fifth embodiment.

FIG. 38 shows an example of the characteristics of smoothing filters C used in the smoothing units 5, 6, 7, having different characteristics for the three primary colors. The filtering characteristic FG3 of the smoothing filter C used for the color green (the second primary color) in smoothing unit 6 is identical to the characteristic FG1 of filter A in FIG. 22. The filtering characteristic FR3 of the smoothing filter C used for the color red (the first primary color) in smoothing unit 5 has gain parameters x, y satisfying the following conditions.

$$0<x<1,\ 0\leqq y<1,\ x>y \text{ and } x+y<1$$

The filtering characteristic FB3 of the smoothing filter C used for the color blue (the third primary color) in smoothing unit 7 has gain parameters x, y satisfying the following conditions.

$$0\leqq x<1,\ 0<y<1,\ x<y \text{ and } x+y<1$$

Figure 39:
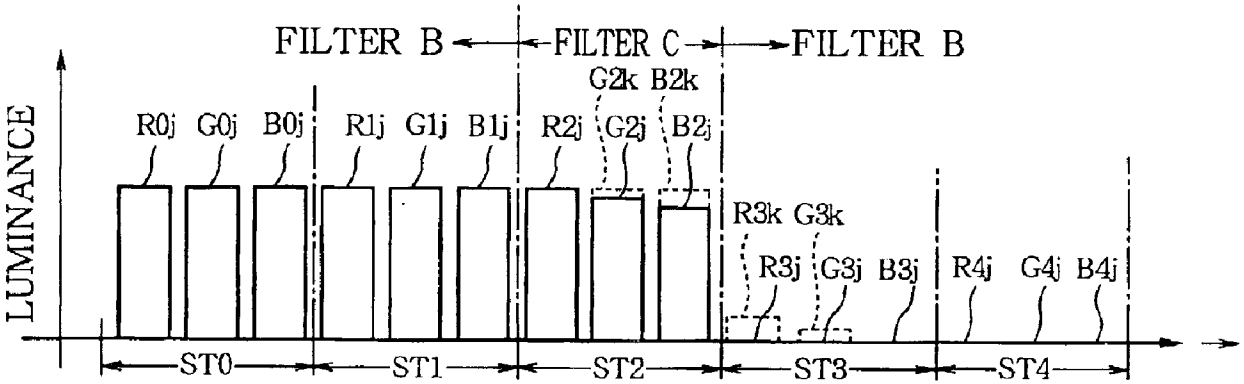
FIGS. 39 and 40 illustrate black-white edges displayed by the fifth embodiment.
Figure 40:
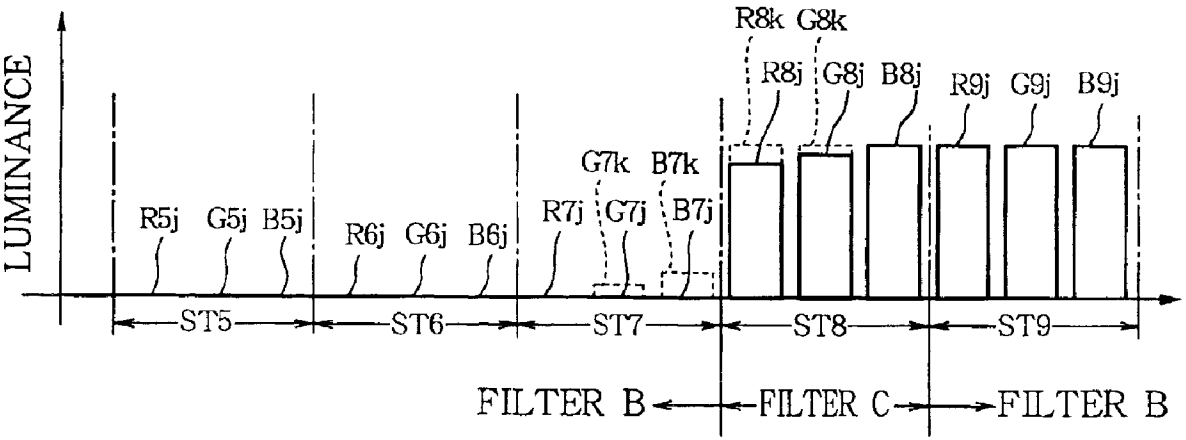

FIGS. 39 and 40 show how the fifth embodiment applies filter B in FIG. 23 and filter C in FIG. 38 to the image data in FIGS. 20 and 21. ST0 to ST9 are pixels, R0*j* to R9*j* are the filtered luminance levels of the corresponding red cells, G0*j* to G9*j* are the filtered luminance levels of the corresponding green cells, and B0*j* to B9*j* are the filtered luminance levels of the corresponding blue cells. The control signals CR1, CG1, CB1 from the detection unit 4 select filter C for pixels ST2 (R2*j*, G2*j*, B2*j*) and ST8 (R8*j*, G8*j*, B8*j*), which are thereby smoothed, and filter B for the other pixels, which are not smoothed.

Specifically, the luminance levels of the cells in pixel ST2 (R2*j*, G2*j*, B2*j*) are reduced by differing amounts (G2*k*, B2*k*), and the luminance levels of the cells in pixel ST8 (R8*j*, G8*j*, B8*j*) are reduced by differing amounts (R8*k*, G8*k*). The luminance levels of the adjacent white pixels ST1 (R1*j*, G1*j*, B1*j*) and ST9 (R9*j*, G9*j*, B9*j*) are not reduced. The luminance levels of the adjacent black pixels ST3 (R3*j*, G3*j*, B3*j*) and ST7 (R7*j*, G7*j*, B7*j*) are not increased. The amounts shown (R3*k*, G3*k*, G7*k*, B7*k*) are increases that would occur if pixels ST3 and ST7 were to be filtered by filter C instead of filter B.

To further explain FIGS. 39 and 40, the filtering characteristics for each color are determined so as to satisfy the following inequalities.

$$R2>G2>B2$$

$$B8>G8>R8$$

Figure 41:
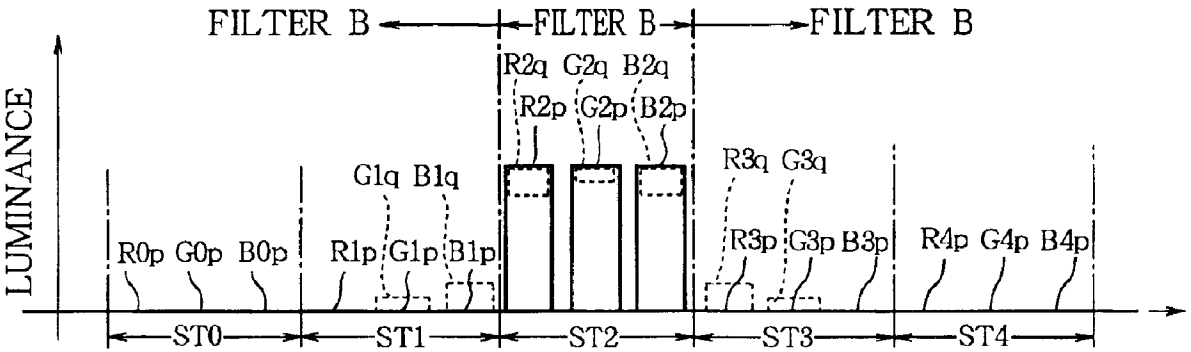
FIG. 41 illustrates a white dot displayed on a black background by the fifth embodiment.
Figure 42:
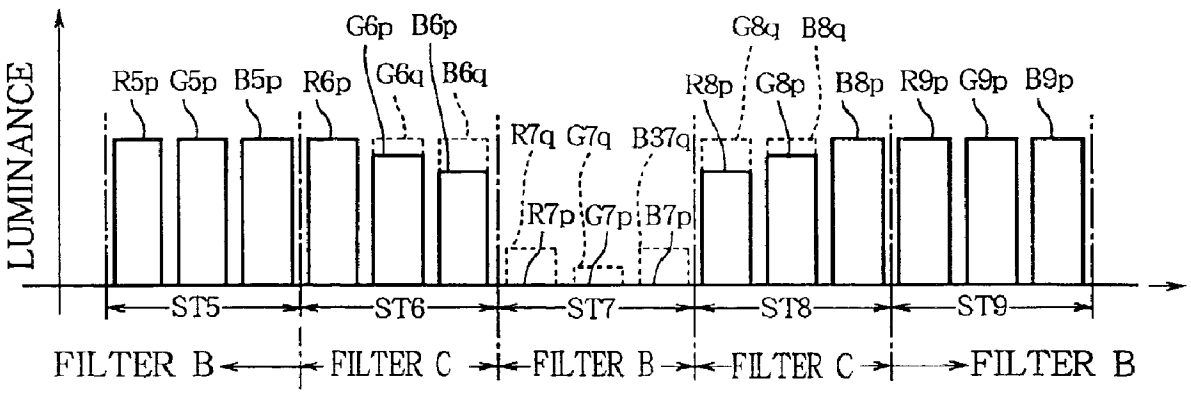
FIG. 42 illustrates a black dot displayed on a white background by the fifth embodiment.

FIGS. 41 and 42 show how the fifth embodiment smoothes the image data in FIGS. 5 and 6. ST0 to ST9 are pixels, R0*p* to R9*p* are the luminance levels of the corresponding red cells, G0*p* to G9*p* are the luminance levels of the corresponding green cells, and B0*p* to B9*p* are the luminance levels of the corresponding blue cells. The control signals CR1, CG1, CB1 from the detection unit 4 select filter C for pixels ST6 (R6*p*, G6*p*, B6*p*) and ST8 (R8*p*, G8*p*, B8*p*), which are thereby smoothed, and filter B for the other pixels, which are not smoothed.

In FIG. 41, which represents a white dot or line on a black background, the smoothing units 5, 6, 7 leave pixels ST0 to ST4 unsmoothed. The luminance levels in pixel ST2 (R2*p*, G2*p*, B2*p*) are not reduced by the indicated amounts (R2*q*, G2*q*, B2*q*). The luminance levels in pixels ST1 and ST3 are not increased by the indicated amounts (G1*q*, B1*q*, R3*q*, G3*q*).

In FIG. 42, which represents a black dot or line on a white background, the luminance levels of the cells in pixels ST6 (R6*p*, G6*p*, B6*p*) and ST8 (R8*p*, G8*p*, B8*p*) are reduced by differing amounts (G6*q*, B6*q*, R8*q*, G8*q*). The luminance levels in pixel ST7 (R7*p*, G7*p*, B7*p*) are not increased by corresponding amounts (R7*q*, G7*q*, B7*q*).

To further explain FIG. 42, to mitigate the problem of thinning when dark lines and letters are displayed on a bright background, the filtering characteristics for each color are determined so as to satisfy the following inequalities.

$$R6>G6>B6$$

$$B8>G8>R8$$

Incidentally, as FIGS. 39 to 42 illustrate, the detection unit in the fifth embodiment may employ various detection methods: it may detect bright parts adjacent to dark parts as in the first embodiment, bright parts adjacent to edges as in the third embodiment, or bright parts adjacent to dark parts having a certain arbitrary width or less as in the fourth embodiment. The fifth embodiment is not limited to any one of these methods.

The fifth embodiment has been described as operating on digital data for the three primary colors, but can be altered to operate on digital image data comprising luminance and chrominance components, or on composite digital image data.

By using smoothing filters with different filtering characteristics for the three primary colors, the fifth embodiment can further reduce the loss of edge sharpness in the image.

In the preceding embodiments, the smoothing units operated on the image data for the three primary colors, but the invention can also be practiced by smoothing a luminance signal, as in the sixth embodiment described below.

Figure 43:
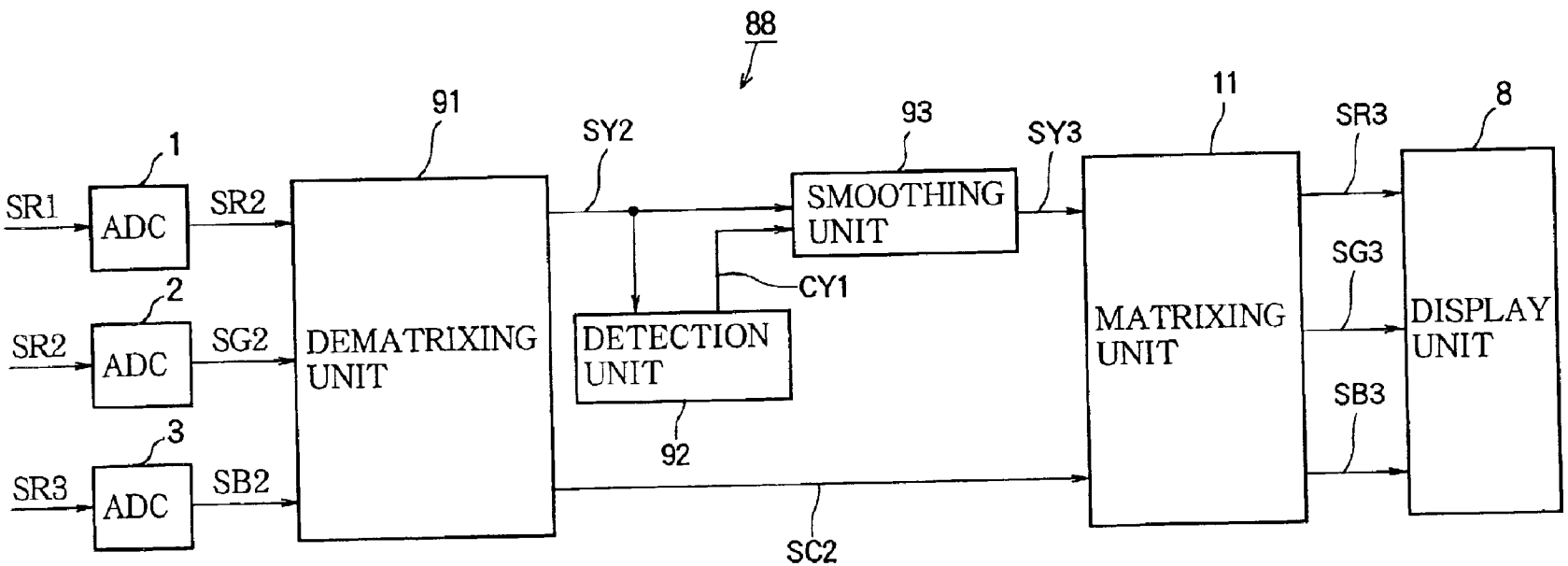
FIGS. 43 and 44 are block diagrams of image display devices illustrating a sixth embodiment of the invention.

Referring to FIG. 43, the sixth embodiment is an image display device 88 comprising analog-to-digital converters 1, 2, 3, a display unit 8, and a matrixing unit 11 as described in the first and second embodiments, a dematrixing unit 91, a detection unit 92, and a smoothing unit 93. The dematrixing unit 91 receives digitized image data SR2, SG2, SB2 from the analog-to-digital converters 1, 2, 3 and performs an operation reverse to that of the matrixing unit 11, generating a digital luminance signal SY2 and a digital chrominance signal SC2. The detection unit 92 generates a control signal CY1 from the digital luminance signal SY2. The smoothing unit 93 smoothes the digital luminance signal SY2 according to the control signal CY1, generating a smoothed digital luminance signal SY3. The matrixing unit 11 receives the smoothed digital luminance signal SY3 and the digital chrominance signal SC2 and generates digital image data SR3, SG3, SB3 of the three primary colors for output to the display unit 8.

Figure 44:
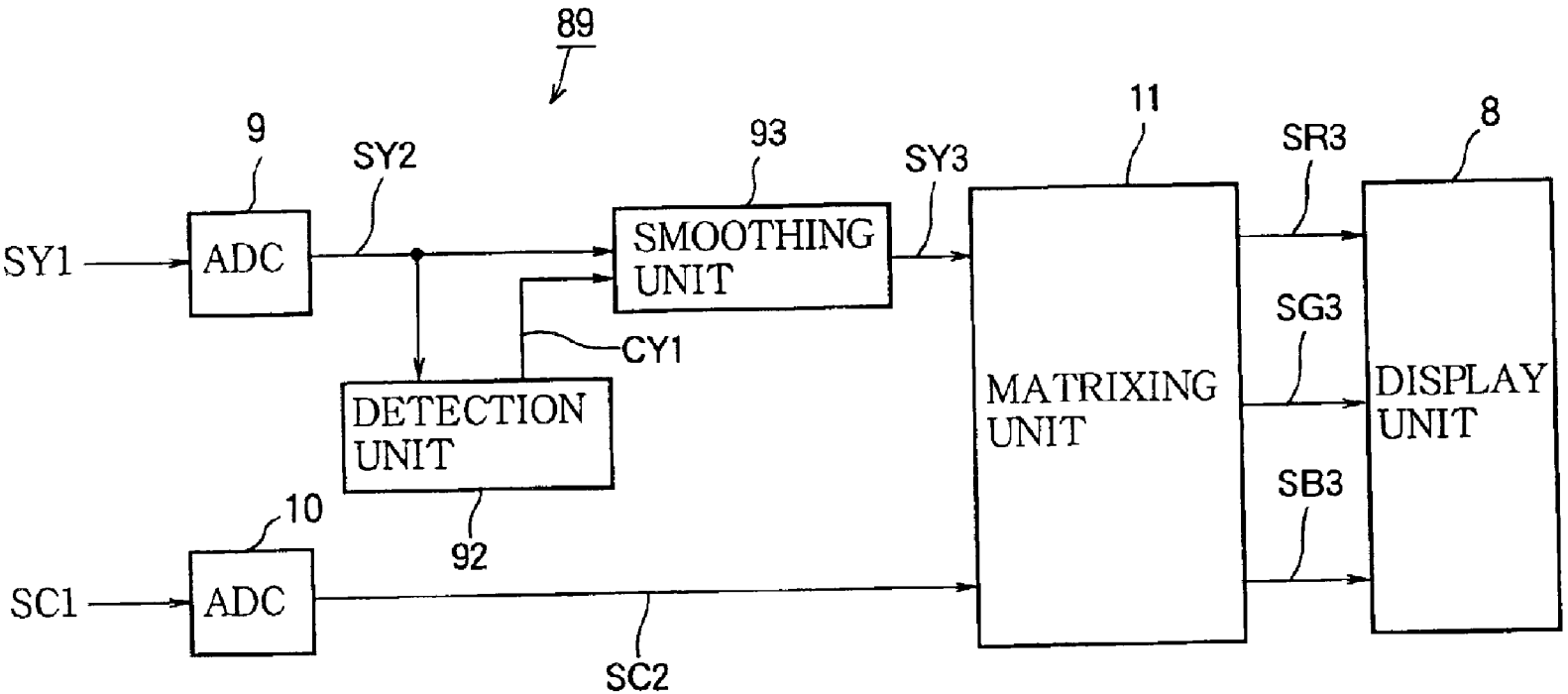

As a variation of the sixth embodiment, FIG. 44 shows an image display device 89 that receives an analog luminance signal SY1 and an analog chrominance signal SC1 instead of analog red-green-blue input signals. Two analog-to-digital converters 9, 10 convert SY1 and SC1 to a digital luminance signal SY2 and a digital chrominance signal SC2. These signals are processed by the detection unit 92, smoothing unit 93, and matrixing unit 11 as in FIG. 43, and the resulting image data SR3, SG3, SB3 are displayed by the display unit 8.

Figure 45:
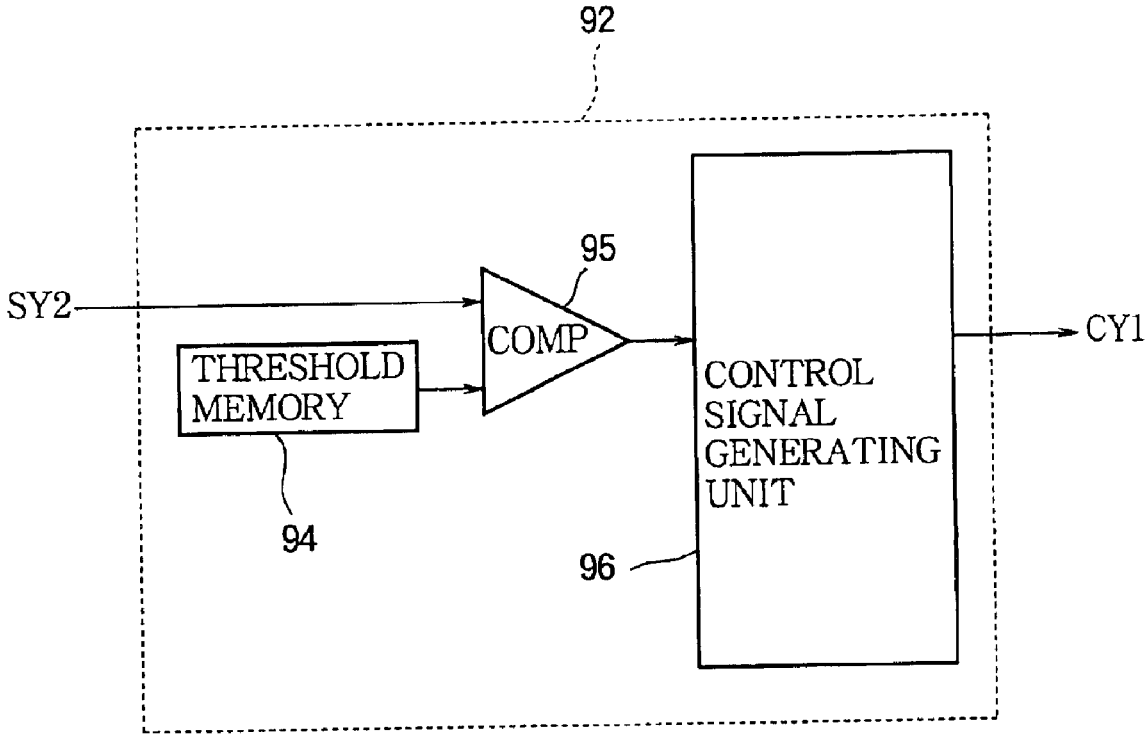
FIG. 45 is a block diagram illustrating the structure of the detection unit in the sixth embodiment.

FIG. 45 shows the internal structure of the detection unit 92 in FIGS. 43 and 44. The detection unit 92 has a comparator 95 for the digital luminance signal SY2, and a threshold memory 96 that stores a threshold value. The comparator 95 supplies a comparison result to a control signal generating unit 96 comprising a microprocessor or the like that generates the control signal CY1. The control signal CY1 selects the filter that smoothes the digital luminance signal SY2 in the smoothing unit 93.

Figure 46:
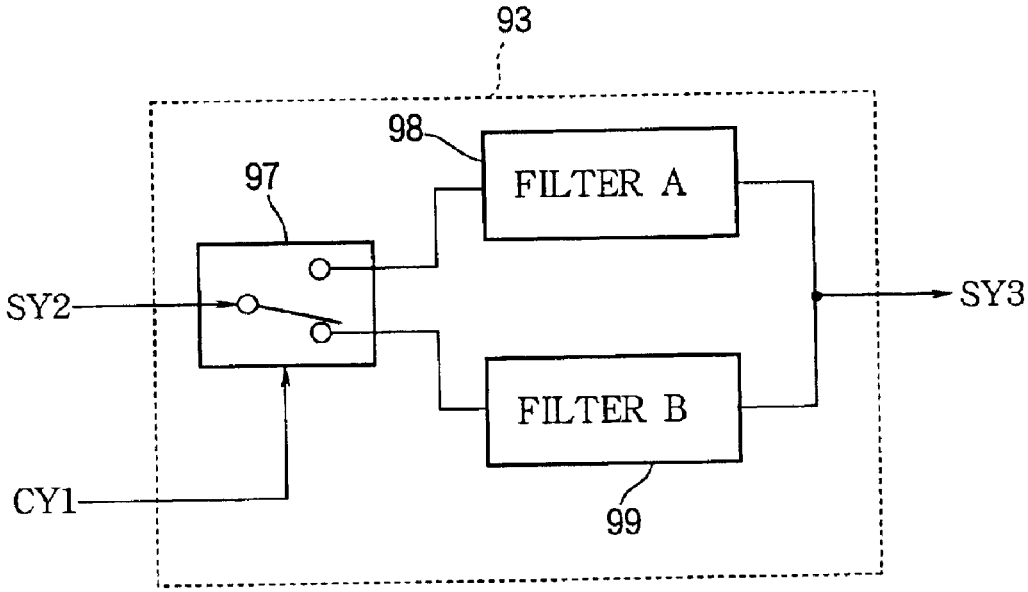
FIG. 46 is a block diagram illustrating the structure of the smoothing unit in the sixth embodiment.

FIG. 46 shows the internal structure of the smoothing unit 93 in FIGS. 43 and 44. The smoothing unit 93 has a switch 97 that receives the digital luminance signal SY2. The switch 97 is controlled by the control signal CY1 from the detection unit 92 so as to send the digital luminance signal SY2 to a selected one of two output terminals. A first filter 98 (filter A) is coupled to one of the output terminals. A second filter 99 (filter B) is coupled to the other output terminal. Filters A and B may have the characteristics described in the first four embodiments, filter A smoothing and filter B not smoothing the digital luminance signal SY2. The output of the selected filter becomes the luminance signal SY3 output from the smoothing unit 93.

Next, the operation of the sixth embodiment will be described. The description will focus on the operation of the detection unit 92 and smoothing unit 93.

In the detection unit 92, the digital luminance signal SY2 is supplied to one input terminal of the comparator 95. The other input terminal of the comparator 95 is connected to the threshold memory 94, and receives a threshold value corresponding to the luminance signal SY2. The comparator 95 compares the luminance signal SY2 with the threshold value stored in the threshold memory 94. The result of the comparison is input to the control signal generating unit 96. From this comparison result, the control signal generating unit 96 makes decisions, using predetermined values, or values resulting from computational processes or the like, and thereby generates the control signal CY1 that is sent to the smoothing unit 93 to select the filtering processing carried out therein.

When the luminance signal SY2 is less than the predetermined threshold value, the luminance signal SY2 is determined to lie in a dark part of the displayed image. Conversely, when the luminance signal SY2 exceeds the predetermined threshold value, the luminance signal SY2 is determined to lie in a bright part of the displayed image. From the luminance data of the dark parts and bright parts as determined above, the detection unit 92 detects bright parts that are adjacent to dark parts, as did the detection unit 14 in the second embodiment. The single filtering operation performed by the smoothing unit 93 has substantially the same final effect, after matrixing by the matrixing unit 11, as the three filtering operations performed by the three smoothing units 5, 6, 7 in the second embodiment.

Other aspects of the operation of the sixth embodiment are generally similar to the operation of the second embodiment.

The image display devices 88, 89 of the sixth embodiment use luminance signal data present or inherent in the image data to detect bright parts of the image that are adjacent to dark parts, and reduce the luminance of these bright parts without increasing the luminance of the adjacent dark parts. The sixth embodiment can mitigate the problem of poor visibility of dark lines and letters displayed on a bright background in a simpler way than in the second embodiment, since only one filtering operation is required instead of three.

In the preceding embodiments, filter characteristics were switched according to the adjacency relationships of bright and dark pixels, and only the luminance levels of bright pixels adjacent to dark pixels were modified, but the invention can also be practiced by using different filtering characteristics for the different primary colors without switching these characteristics according to bright-dark adjacency relationships, as in the seventh embodiment described below.

Figure 47:
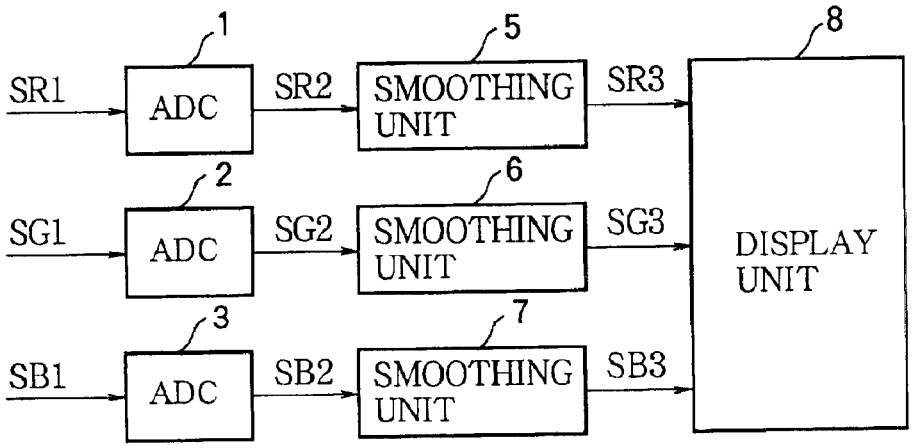
FIGS. 47, 48, 49, and 50 are block diagrams of image display devices illustrating a seventh embodiment of the invention.

Referring to FIG. 47, the seventh embodiment comprises analog-to-digital converters 1, 2, 3, smoothing units 5, 6, 7, and a display unit 8 as described in the preceding embodiments, except that each smoothing unit has only a single filter and no switch.

Figure 48:
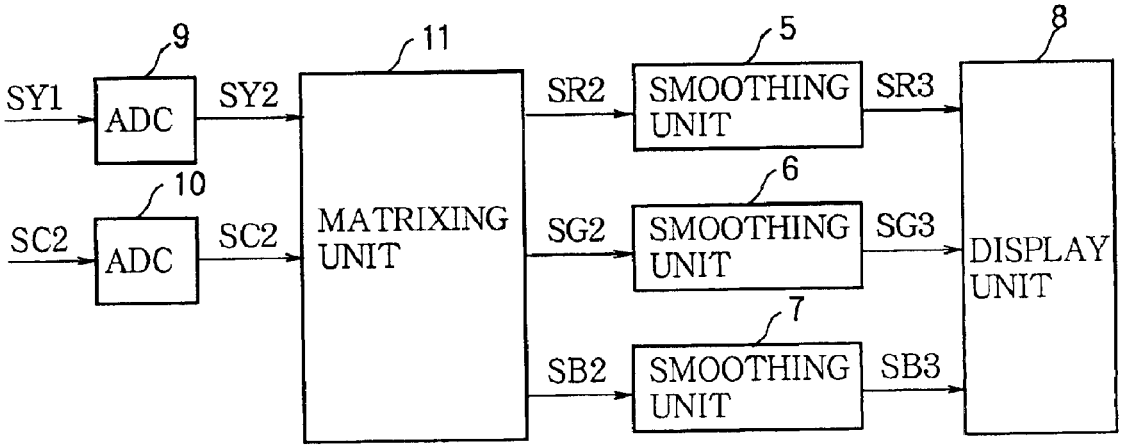

In a variation of the seventh embodiment, shown in FIG. 48, the image display device receives an analog luminance signal SY1 and an analog chrominance signal SC2, which are digitized by analog-to-digital converters 9, 10, then converted to digital image data SR2, SG2, SB2 for the three primary colors by a matrixing unit 11. The digital image data SR2, SG2, SB2 are filtered by smoothing units 5, 6, 7 as described above, all pixels being smoothed but different filtering characteristics being used for different primary colors.

Figure 49:
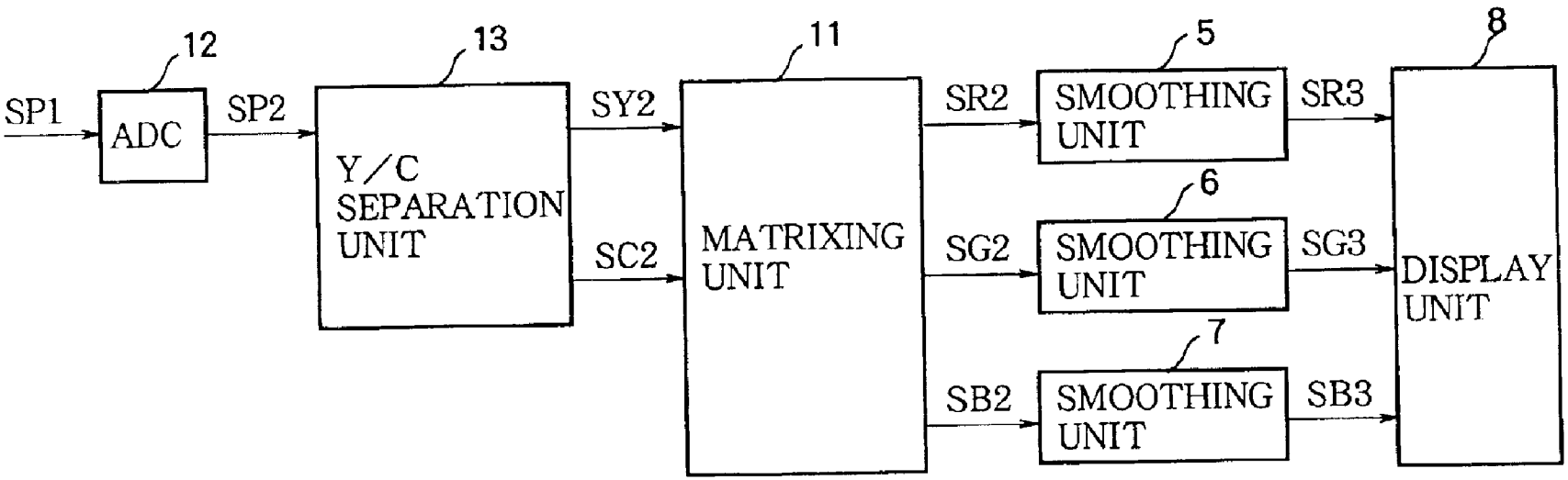

In another variation of the seventh embodiment, shown in FIG. 49, the image display device receives an analog composite signal SP1, which is digitized by an analog-to-digital converter 12, separated into a digital luminance signal SY2 and a digital chrominance signal by a luminance-chrominance separation unit 13, then converted to digital image data SR2, SG2, SB2 by a matrixing unit 11 and smoothed as described above.

Figure 50:
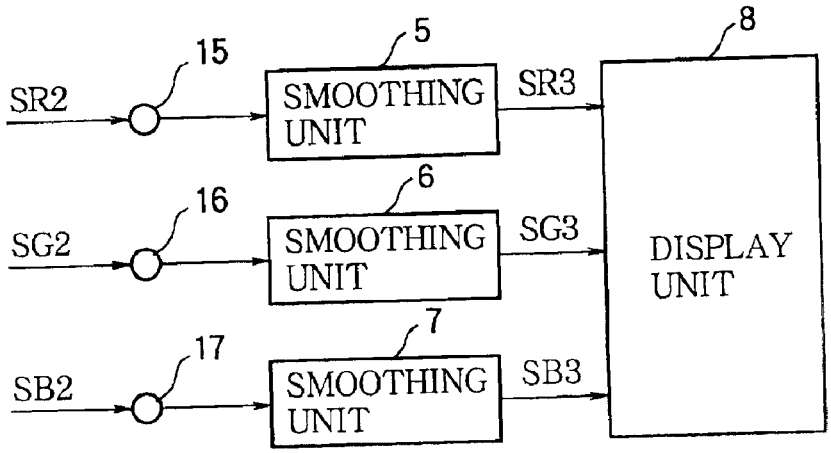

In yet another variation of the seventh embodiment, shown in FIG. 50, the image display device receives digital image data SR2, SG2, SB2 for the three primary colors at respective digital input terminals 15, 16, 17. The received data are supplied directly to the smoothing units 5, 6, 7, then displayed by the display unit 8.

In other variations of the seventh embodiment, the image display device receives a digital luminance signal and a digital chrominance signal, or a digital composite signal. Drawings and descriptions will be omitted.

Figure 51:
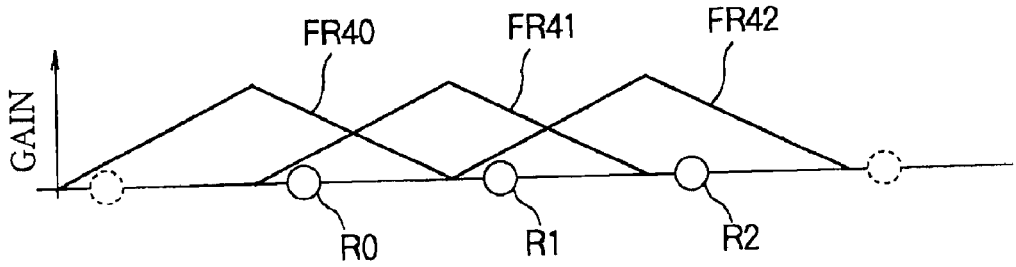
FIGS. 51, 52, and 53 illustrates filtering characteristics used in the seventh embodiment.

FIG. 51 illustrates the filtering characteristic of smoothing unit 5 for the first primary color (red) in the seventh embodiment. R0, R1, and R2 represent the positions of the centers of three red cells in adjacent pixels. FR40, FR41, and FR42 represent the filtering characteristic of smoothing unit 5 as applied to these three cells. For example, the filtered luminance level of cell R1 is obtained from the unfiltered data for cell R1 and its adjacent cells according to characteristic FR41.

Figure 52:
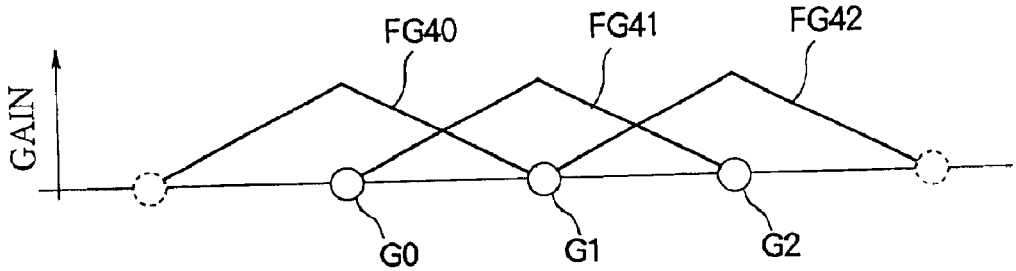
Figure 53:
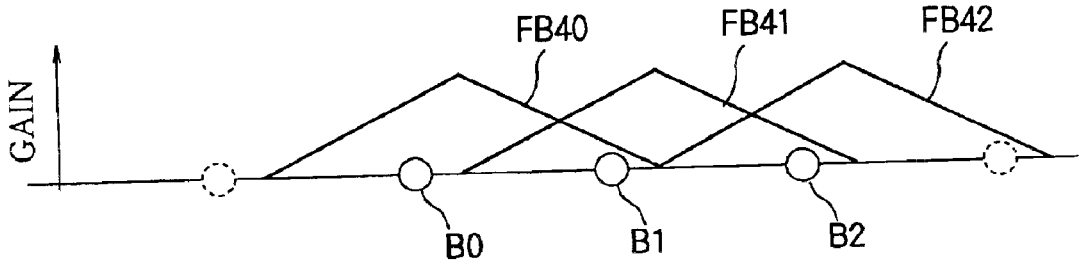

Similarly, in FIG. 52, FG40, FG41, and FG42 represent the filtering characteristic of smoothing unit 6 as applied to three green cells G0, G1, G2 in adjacent pixels. In FIG. 53, FB40, FB41, and FB42 represent the filtering characteristic of smoothing unit 7 as applied to three blue cells B0, B1, B2 in adjacent pixels.

Figure 54:
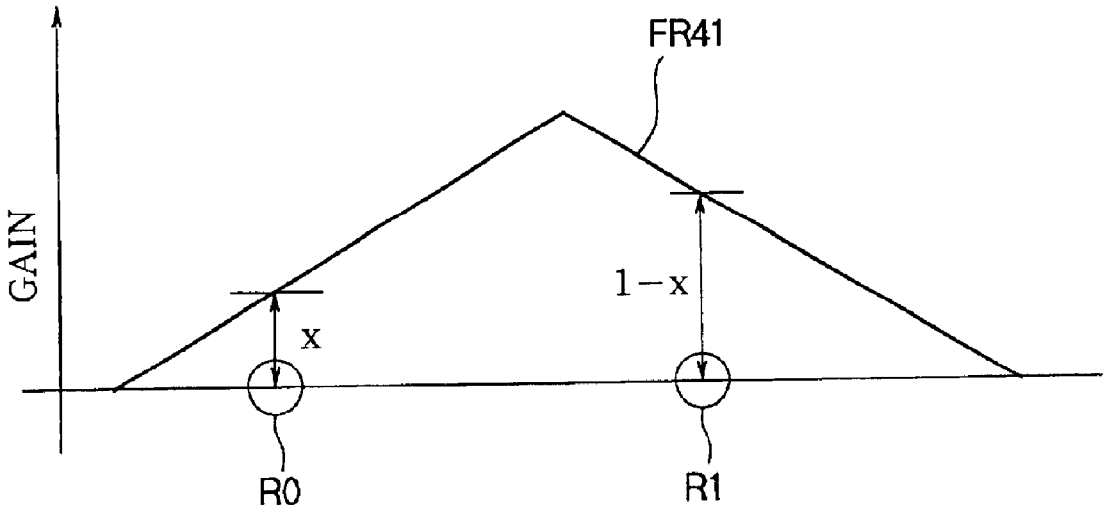
FIG. 54 illustrates gain parameters of the red filtering characteristic in the seventh embodiment.

The filtering characteristic FR41 of cell R1 is further illustrated in FIG. 54. The filtered luminance level Ro1 of cell R1 is obtained from the unfiltered luminance levels of cell R0 and R1 as follows.

$$Ro1=(x\times R0)+\{(1-x)\times R1\}$$

In terms of the gain parameters x, y described earlier, x has a small positive value ($0<x<0.5$) and y is zero. The filtered luminance level of a red cell is a combination of the unfiltered levels of that red cell and the adjacent red cell to its left, the major contribution coming from the cell itself.

In the filtering characteristic of smoothing unit 6, both gain parameters x and y are zero. The filtered luminance level of a green cell is equal to the unfiltered luminance level of the same cell. Green luminance levels are not smoothed.

In the filtering characteristic of smoothing unit 7, x is zero and y has a small positive value ($0<y<0.5$). The filtered luminance level of a blue cell is a combination of the unfiltered levels of that blue cell and the adjacent blue cell its right, the major contribution coming from the cell itself.

The seventh embodiment operates as described above. The input analog signals SR1, SG1, SB1 are converted to digital image data SR2, SG2, SB2 by the analog-to-digital converters 1, 2, 3, the digital image data SR2, SG2, SB2 are filtered by the smoothing units 5, 6, 7, and the smoothed data SR3, SG3, SB3 are displayed by the display unit 8.

Figure 55:
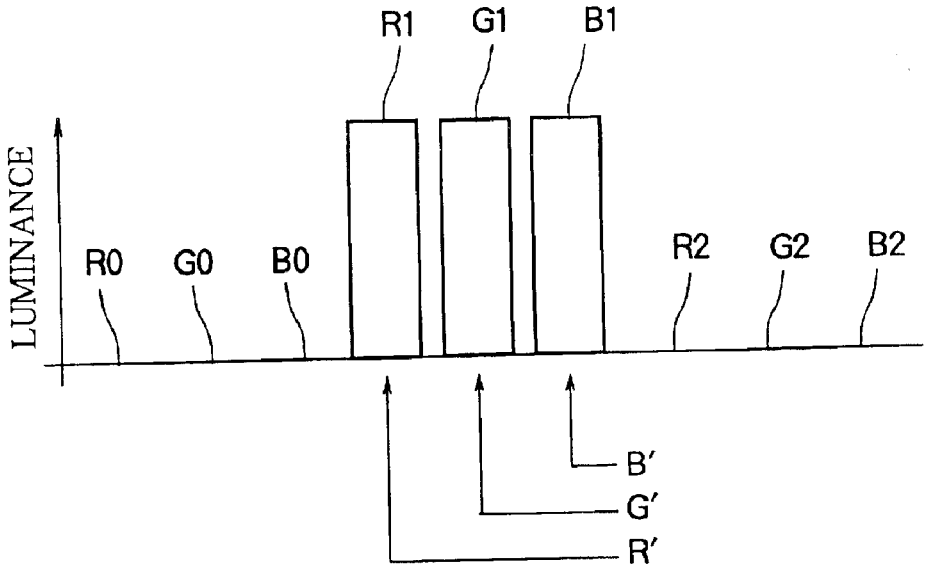
FIG. 55 illustrates image data for a white dot on a black background.

FIG. 55 illustrates a white dot or line displayed on a black background, as represented in the digital image data SR2, SG2, SB2 before smoothing. R0 to R1 indicate the luminance levels of the red cells, G0 to G2 indicate the luminance levels of the green cells, and B0 to B2 indicate the luminance levels of the blue cells in three horizontally adjacent pixels. The luminance centroids R', G', B' of the three primary colors are separated by distances equal to the spacing of the cells.

Figure 56:
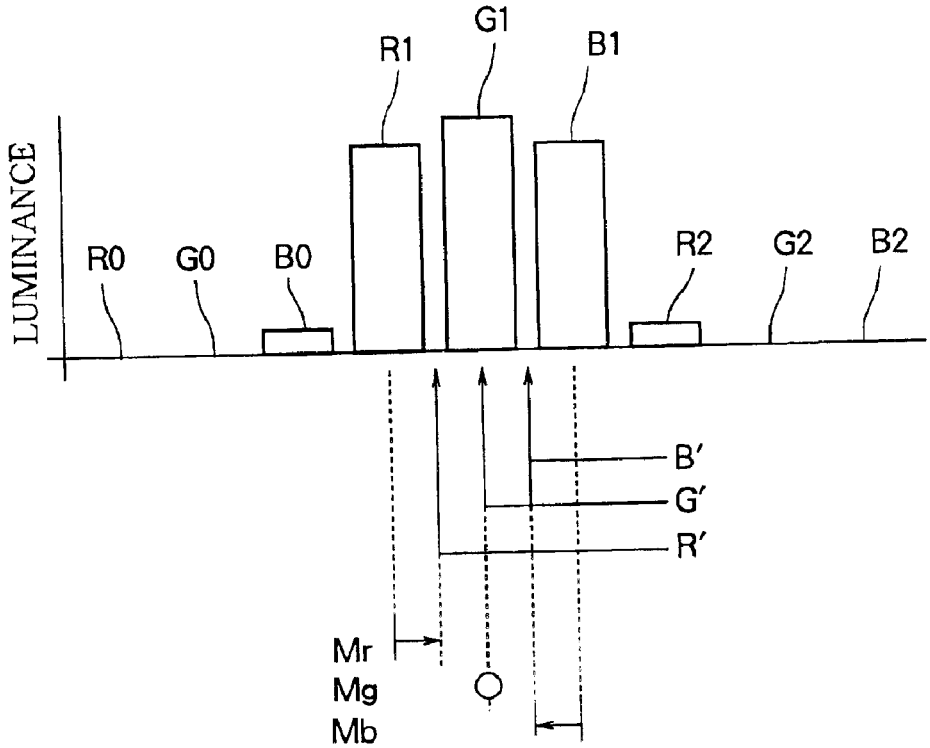
FIG. 56 illustrates the white dot in FIG. 55 as displayed by the seventh embodiment.

FIG. 56 illustrates the same dot or line as represented in the filtered data SR3, SG3, SB3. The luminance levels R2 and B0 have been increased, since they receive contributions from R1 and B1, respectively. The luminance levels R1 and B1 have been correspondingly reduced. As a result, the blue luminance centroid B' has moved to the left by an amount Mb, and the red luminance centroid R' has moved to the right by an amount Mr, while the green luminance centroid G' is left unchanged. The three luminance centroids R', G', B' are thereby brought closer together.

If a negative value represents motion to the left and a positive value represents motion to the right, the motion Mr of the red luminance centroid R', the motion Mg of the green luminance centroid G', and the motion Mb of the blue luminance centroid B' have positive, zero, and negative values, respectively.

$$Mr>0$$

$$Mg=0$$

$$Mb<0$$

The data for all pixels are filtered as illustrated above. Red luminance levels are smoothed by being partially redistributed to the right. Blue luminance levels are smoothed by being partly redistributed to the left. The luminance centroids of the red and blue data for each pixel are thereby shifted closer to the center of the pixel.

The effect of the seventh embodiment is that the tendency of white edges to appear tinged with unwanted colors is reduced. For example, a vertical white line appears white all the way across and does not appear to have a red tinge at its left edge and a blue tinge at its right edge, as it did in the prior art. Tingeing effects at all types of vertical and diagonal edges in the displayed image are similarly reduced.

At the same time, the loss of edge sharpness that can result from smoothing is reduced. At the right edge of the white dot in FIG. 56, for example, the smoothing effect extends only out to the adjacent red cell R2, and not to the more distant green and blue cells G2, B2, which retain their zero luminance levels. At the left edge, the smoothing effect extends only to the adjacent blue cell B0 and not to the more distant red and green cells R0, G0, both of which remain at the zero luminance level.

Figure 57:
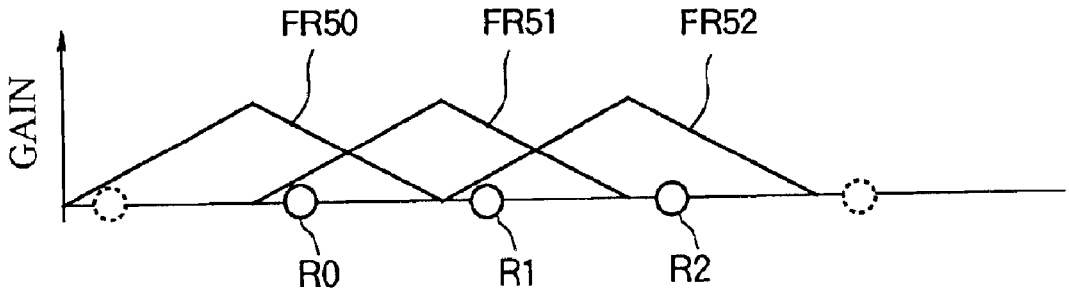
FIGS. 57, 58, and 59 illustrates filtering characteristics used in a variation of the seventh embodiment.
Figure 58:
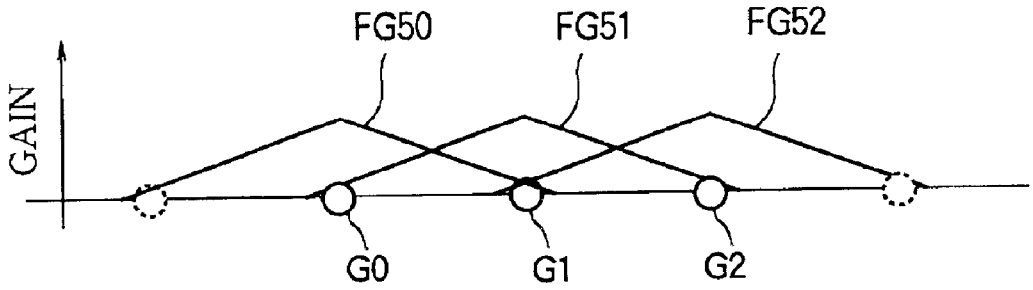
Figure 59:
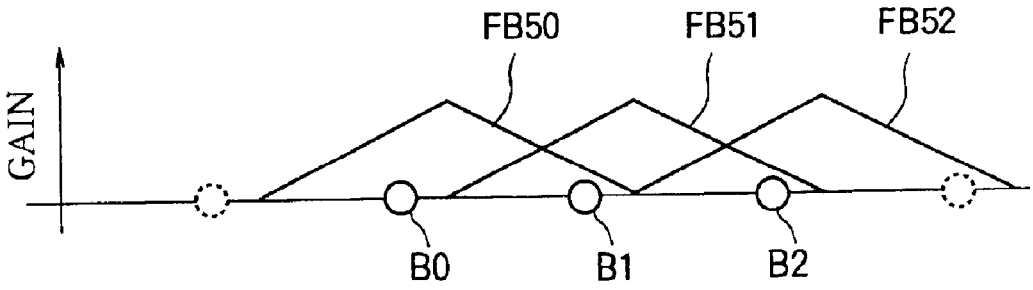
Figure 60:
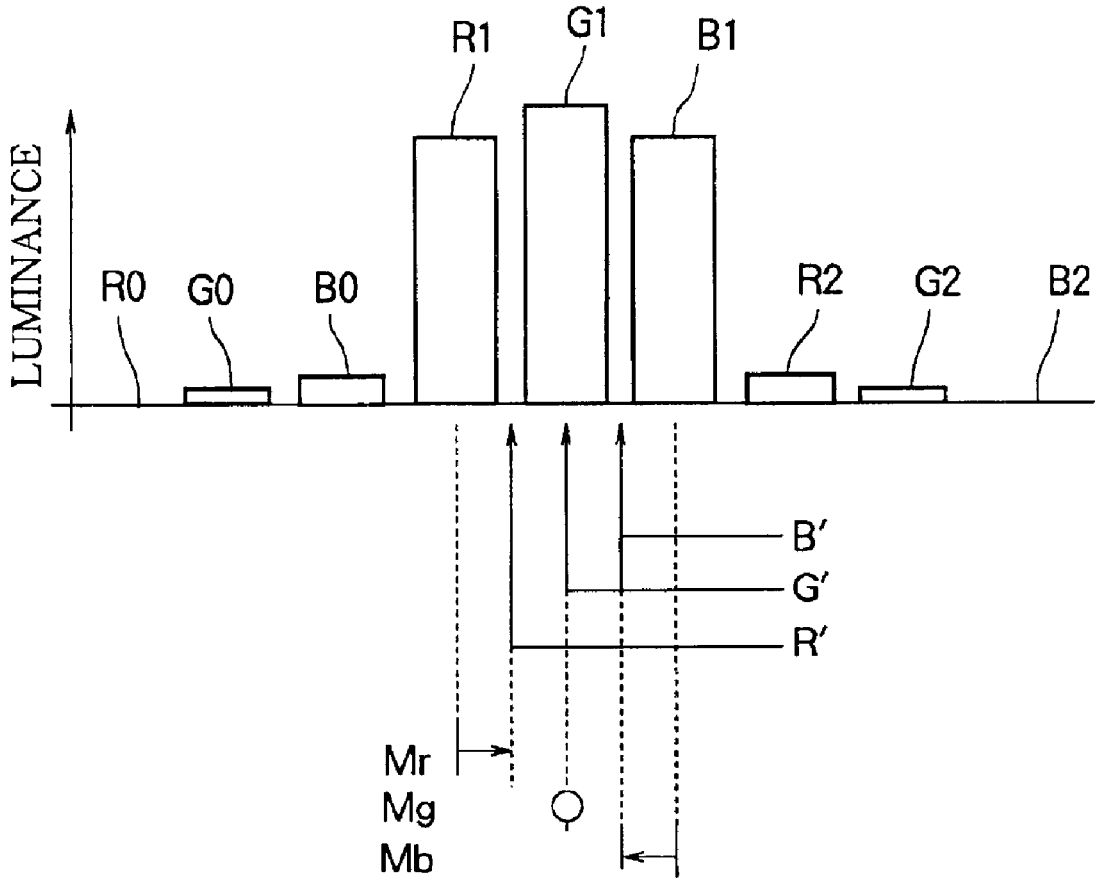
FIG. 60 illustrates the white dot in FIG. 55 as displayed by this variation of the seventh embodiment.

In a variation of the seventh embodiment, the middle color (green) is smoothed in a symmetrical fashion, instead of not being smoothed at all. This can be accomplished by widening the passband of the filtering characteristic of smoothing unit 6. For example, smoothing unit 5 may have the filtering characteristics FR50, FR51, FR52 shown in FIG. 57, smoothing unit 6 may have the broader filtering characteristics FG50, FG51, FG52 shown in FIG. 58, and smoothing unit 7 may have the filtering characteristics FB50, FB51, FB52 shown in FIG. 59. The other symbols (R0 etc.) in these drawings have the same meanings as in FIGS. 51 to 53. FIG. 60 shows the result of applying these filtering characteristics to the image data in FIG. 55. The G1 luminance level is now partly redistributed to G0 and G2 in the adjacent pixels. This variation further reduces the red and blue edge-tingeing effect, although with some loss of edge sharpness.

In the seventh embodiment, the luminance centroids of the two outer primary colors in each pixel were shifted symmetrically in opposite directions, while the luminance centroid of the central primary color remained stationary, but the invention can also be practiced by shifting the luminance centroids of all three primary colors asymmetrically, as in the eighth embodiment described below.

The eighth embodiment has the same structure as the seventh embodiment, differing only in the filtering characteristics of the smoothing units 5, 6, 7. If Mr, Mg, and Mb represent the amounts by which the red, green, and blue luminance centroids are shifted, the filtering characteristics satisfy the following relations $$Mr>0$$

$$Mg>0$$

$$Mb>0$$

$$Mr\geqq Mg\geqq Mb$$

Figure 61:
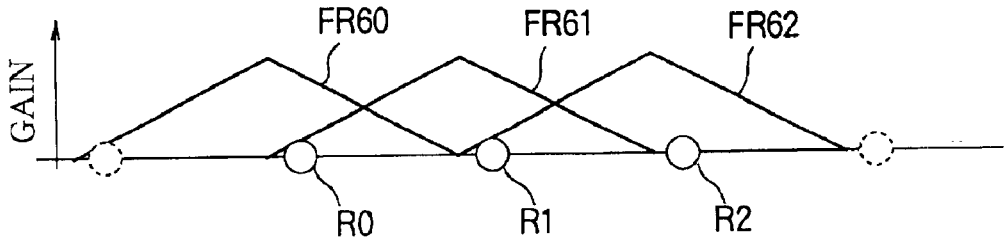
FIGS. 61, 62, and 63 illustrates filtering characteristics used in an eighth embodiment.
Figure 62:
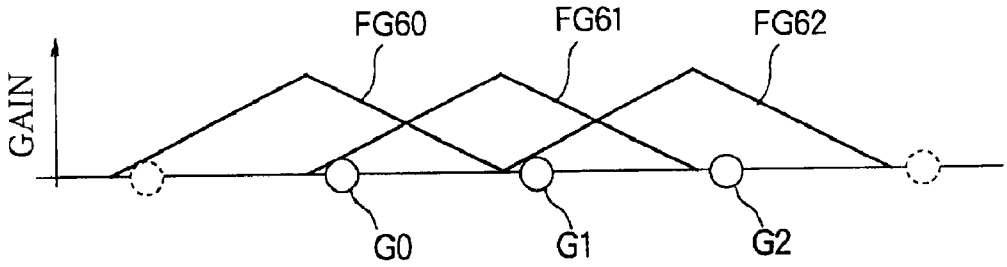
Figure 63:
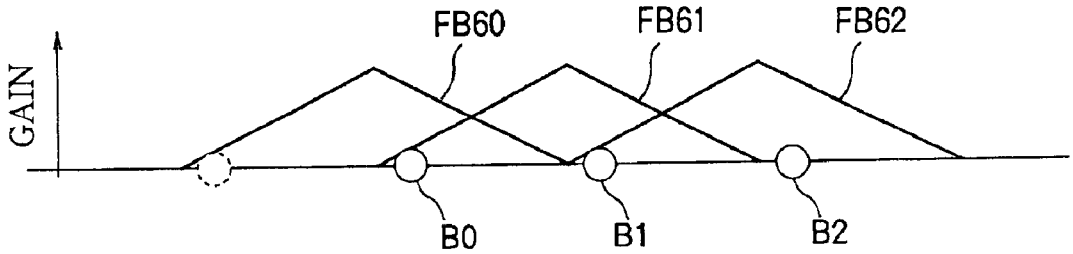

For example, smoothing unit 5 may operate with the characteristics FR60, FR61, FR62 shown in FIG. 61, smoothing unit 6 may operate with the characteristics FG60, FG61, FG62 shown in FIG. 62, and smoothing unit 7 may operate with the characteristics FB60, FB61, FB62 shown in FIG. 63. The notation in these drawings is the same as in FIGS. 51, 52, and 53, so a detailed description will be omitted, save to note that all three smoothing units operate with the same filtering characteristic.

Figure 64:
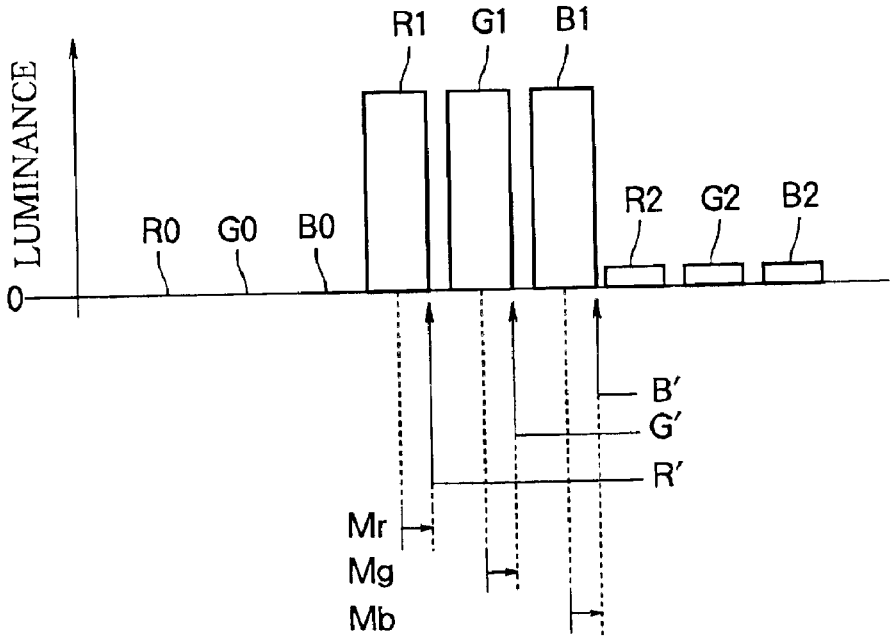
FIG. 64 illustrates the white dot in FIG. 55 as displayed by the eighth embodiment.

FIG. 64 shows the image data in FIG. 55 after filtering with the characteristics shown in FIGS. 61, 62, and 63. The same notation is used as in FIG. 56. Luminance levels R1, GI, Bl are partly redistributed to the right, so that R2, G2, and B2 acquire small positive values, while the luminance levels R0, G0, B0 to the left all remain zero. All three luminance centroids R', G', B' are shifted by equal amounts to the right, smoothing the right edge of the displayed white line or dot. The left edge is not smoothed and remains sharp.

Figure 12:
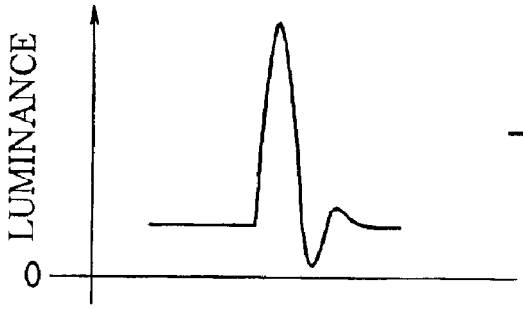
FIG.12 PRIOR ART
FIG. 12 shows a signal waveform illustrating ringing.
Figure 13:
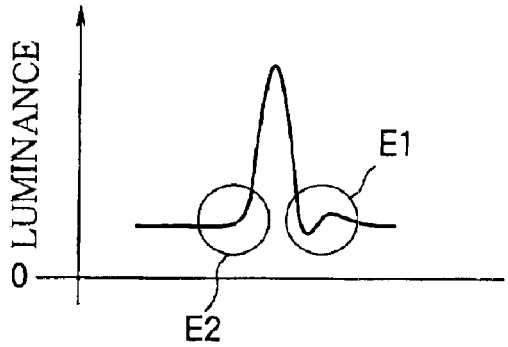
FIG.13 PRIOR ART
FIG. 13 illustrates the effect of conventional smoothing on the waveform in FIG. 12.
Figure 65:
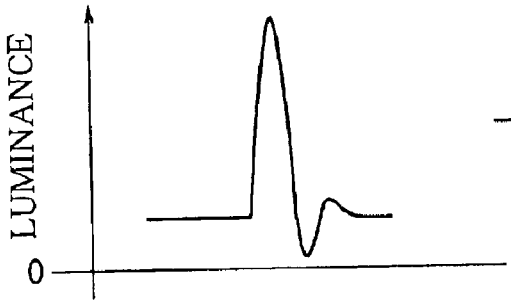
FIG. 65 shows another signal waveform illustrating ringing.
Figure 66:
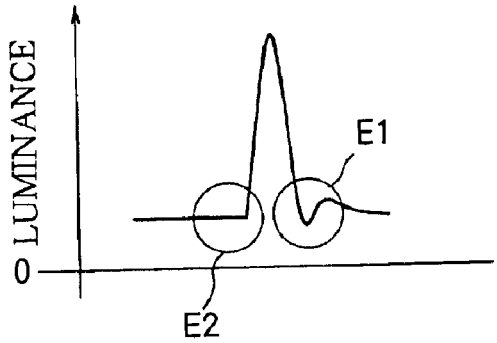
FIG. 66 illustrates the effect of smoothing in the eighth embodiment on the waveform in FIG. 12.

FIG. 65 shows an input signal waveform of a white line or dot with ringing. As in the similar waveform in FIG. 12, ringing occurs at the right edge of the line or dot, because the screen is scanned from left to right. FIG. 66 shows the effect of the eighth embodiment on this waveform. As noted above, the left edge remains sharp while the right edge is smoothed, so the ringing at the right edge E1 is reduced without any loss of sharpness at the left edge E2.

The filtering characteristics in FIGS. 61, 62, and 63, being identical, satisfied the relation Mr=Mg=Mb. However, a similar ringing-suppression effect, without loss of left-edge sharpness, is obtained if Mr>Mg>Mb>0. This relationship is preferable in that the ringing amplitude decreases with distance from the right edge.

In a variation of the eighth embodiment, two of the luminance centroids are shifted to the right and one is shifted to the left. The following relationships are then satisfied.

$$Mr>0$$

$$Mg>0$$

$$Mb<0$$

$$Mr \geqq Mg>Mb$$

Figure 67:
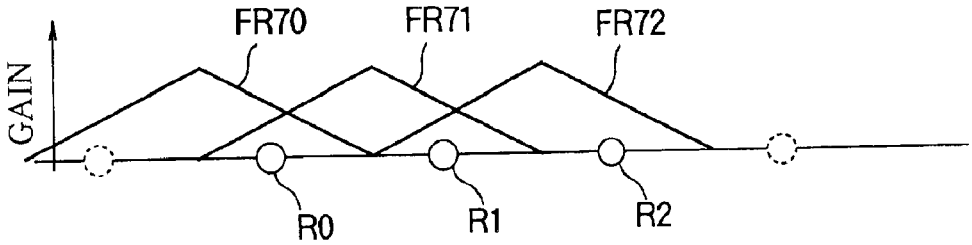
FIGS. 67, 68, and 69 illustrate filtering characteristics used in a variation of the eighth embodiment.
Figure 68:
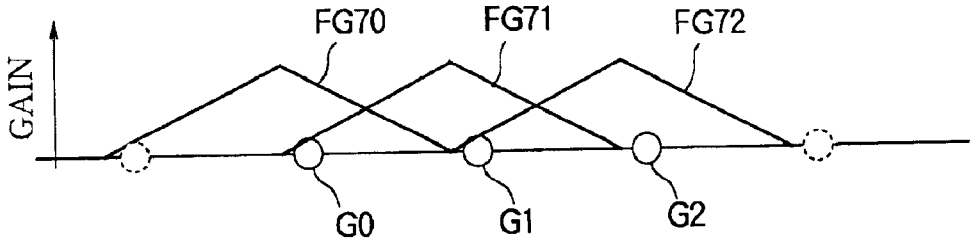
Figure 69:
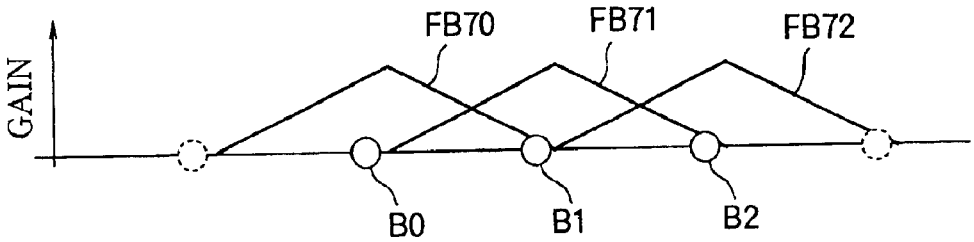

FIGS. 67, 68, and 69 illustrate filtering characteristics FR70 to FR72 for red, FG70 to FG72 for green, and FB70 to FB72 for blue satisfying the inequalities above. The same notation is used as in FIGS. 51, 52, and 53.

Figure 70:
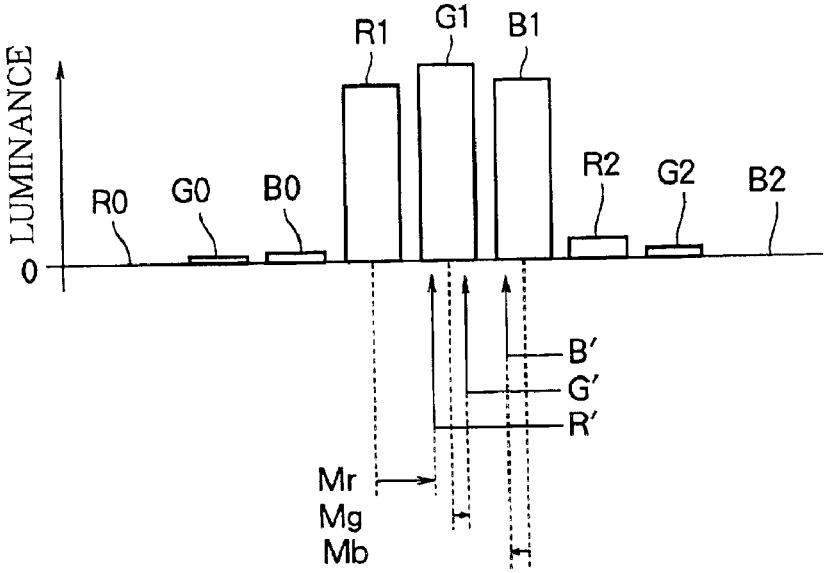
FIG. 70 illustrates the white dot in FIG. 55 as displayed by this variation of the eighth embodiment.

FIG. 70 shows the image data in FIG. 55 after filtering with the characteristics conceptually similar to those shown in FIGS. 67, 68, and 69, satisfying the inequalities above. The same notation is used as in FIG. 56. The red luminance centroid R' moves a considerable distance to the right, while the green luminance centroid G' moves a short distance to the right and the blue luminance centroid B' moves a short distance to the left. As a result, the three luminance centroids are brought closer together, and the tingeing of the edges is reduced, as in the seventh embodiment. Both edges of the white dot or line are smoothed, but the right edge is smoothed more than the left edge. Consequently, ringing is greatly attenuated at the right edge, with only a small loss of sharpness at the left edge.

This variation provides the combined effects of the seventh and eighth embodiments.

In regard to all of the embodiments, the three cells in each pixel do not have to be arranged in red-green-blue order from left to right. Other orderings are possible.

The invention can be practiced in either hardware or software.

Those skilled in the art will recognize that further variations are possible within the scope claimed below.

What is claimed is:

1. An image display device for displaying an image according to image data, comprising:

a detection unit for detecting bright parts of the image that are adjacent to dark parts of the image, from the image data, the bright parts having a higher luminance value than the dark parts;

a smoothing unit coupled to the detection unit, for smoothing the bright parts of the image, detected by the detection unit, that are adjacent to the dark parts of the image by filtering the image data, leaving the dark parts of the image unsmoothed; and a display unit coupled to the smoothing unit, for displaying the image data, including the smoothed bright parts of the image and the unsmoothed dark parts of the image.

2. The image display device of claim 1, wherein the image data include data for different primary colors, and the detection unit detects said bright parts separately for each primary color.

3. The image display device of claim 1, wherein the detection unit also detects edges in the image from the image data, and controls the smoothing unit so that only bright parts of the image that are adjacent to the detected edges are smoothed.

4. The image display device of claim 1, wherein the detection unit also detects dark parts of the image having at most a predetermined width, and controls the smoothing unit so that only bright parts of the image that are adjacent to the detected dark parts having at most the predetermined width are smoothed.

5. The image display device of claim 1, wherein the image data include data for different primary colors, and the smoothing unit uses different filtering characteristics for the different primary colors.

6. The image display device of claim 1, wherein the image data include a luminance signal, and the smoothing unit filters the luminance signal.

7. The image display device of claim 1, wherein the smoothing unit includes at least two filters, the image data being selectively filtered through one of the at least two filters determinative upon a control signal produced by the detection unit.

8. The image display device of claim 7, wherein a first filter is selected if the detection unit detects a bright part of the image adjacent to a dark part of the image.

9. The image display device of claim 7, wherein a second filter is selected if the detection unit does not detect a bright part of an image adjacent to a dark part of the image.

10. A method of displaying an image according to image data, comprising the steps of:

(a) detecting dark parts of the image from the image data;

(b) detecting bright parts of the image that are adjacent to the dark parts of the image, from the image data, the bright parts having a higher luminance value than the dark parts;

(c) smoothing the bright parts detected in said step (b) by filtering the image data, leaving the dark parts of the image unsmoothed; and (d) displaying the image data, including the smoothed bright parts of the image and the unsmoothed dark parts of the image.

11. The method of claim 10, further comprising the steps of;

(e) detecting edges in the image from the image data; and (f) detecting bright parts in the image that are adjacent to the detected edges;

wherein only the bright parts detected in said step (f) are smoothed in said step (c).

12. The method of claim 10, further comprising the steps of:

(g) detecting dark parts of the image having at most a predetermined width; and (h) detecting bright parts in the image that are adjacent to the dark parts detected in said step (g);

wherein only the bright parts detected in said step (h) are smoothed in said step (c).

13. The method of claim 10, wherein the image data include data for different primary colors, and said step (c) uses different filtering characteristics for the different primary colors.

14. The method of claim 10, further including selecting one of at least two filters for filtering the image signal, the selection being based on a control signal created during the detection of dark parts and bright parts.

15. The method of claim 14, wherein a first filter is selected if a bright part of the image adjacent to a dark part of the image is detected.

16. The image display device of claim 14, wherein a second filter is selected if a bright part of an image adjacent to a dark part of an image is not detected.

17. An image display device for displaying an image according to image data, comprising:

a detection unit for detecting bright pixels of the image that are adjacent to dark pixels of the image, from the image data, a smoothing unit coupled to the detection unit, for smoothing the bright pixels of the image, detected by the detection unit, that are adjacent to the dark pixels of the image by filtering the image data, leaving the dark pixels of the image unsmoothed; and a display unit coupled to the smoothing unit, for displaying the image data, including the smoothed bright pixels of the image and the unsmoothed dark pixels of the image.

18. A method of displaying an image according to image data, comprising the steps of:

(a) detecting dark pixels of the image from the image data;

(b) detecting bright pixels of the image that are adjacent to the dark pixels of the image, from the image data, (c) smoothing the bright pixels detected in said step (b) by filtering the image data, leaving the dark pixels of the image unsmoothed; and (d) displaying the image data, including the smoothed bright pixels of the image and the unsmoothed dark pixels of the image.

* * * * *